US010976096B2

(12) United States Patent
Seddelmeyer

(10) Patent No.: US 10,976,096 B2
(45) Date of Patent: Apr. 13, 2021

(54) REFRIGERATED ENCLOSURE OPENING AND METHODS

(71) Applicant: Kenneth Lee Seddelmeyer, Jackson, TN (US)

(72) Inventor: Kenneth Lee Seddelmeyer, Jackson, TN (US)

( * ) Notice: Subject to any disclaimer, the term of this patent is extended or adjusted under 35 U.S.C. 154(b) by 33 days.

(21) Appl. No.: 16/443,811

(22) Filed: Jun. 17, 2019

(65) Prior Publication Data

US 2020/0141626 A1 May 7, 2020

Related U.S. Application Data

(60) Provisional application No. 62/756,530, filed on Nov. 6, 2018.

(51) Int. Cl.
*F25D 21/04* (2006.01)

(52) U.S. Cl.
CPC ..... *F25D 21/04* (2013.01)

(58) Field of Classification Search
CPC ..... F25D 21/04; F25D 13/06; F25D 13/062; F25D 13/065; F25D 13/067; A23G 9/14
See application file for complete search history.

(56) References Cited

U.S. PATENT DOCUMENTS 5,203,175 A * 4/1993 Farrey ..... F25D 21/04 62/156
5,520,013 A * 5/1996 Kuo ..... A23L 3/001 62/378
6,408,636 B1 * 6/2002 Backes ..... F25D 21/04 62/275
2004/0134128 A1 * 7/2004 Berry ..... E06B 7/12 49/231
2012/0313497 A1 * 12/2012 Jang ..... F25D 23/069 312/405

* cited by examiner

*Primary Examiner* — David J Teitelbaum

(57) ABSTRACT

A heated opening through the walls, floor, or ceiling of a refrigerated enclosure, and a method for reducing or eliminating frost and condensation on the surfaces of the opening and around the opening. An opening that reduces the chances of microbiological growth with a design that promotes ease of sanitation and reduction in microbiological growth niches. Ease of replacement of heating element parts. Reduced chances for debris or water from reaching the inner surfaces of the opening and any items passing through the opening. Reduced or eliminated frost and condensation on conveyor frames and similar components used with conveyor belts or similar parts passing through the opening.

14 Claims, 25 Drawing Sheets

ISOMETRIC VIEW

FIGURE 2 –
EXPLODED VIEW

HOLE IN BACK SIDE ONLY FOR THERMOWELLS
HEATER
10
THERMOSTAT
4
HEATER
HEATER
HEATER

BORE FOR DIAMETER OF THERMOSTAT
4
THERMOWELL THERMOSTAT - FIGURE 4

HALF PIPE COUPLING - FIGURE 5

PIPE PLUG - FIGURE 6

INNER SLEEVE - FIGURE 7

EXTERIOR WALL PLATE - FIGURE 8

INTERIOR WALL PLATE - FIGURE 9

THERMOWELL HEATER - FIGURE 10

SLEEVE - FIGURE 11

INNER SLEEVE FACE - FIGURE 12

OUTER SLEEVE FACE - FIGURE 13

INTERIOR PLATE - FIGURE 14

OUTER PLATE - FIGURE 15

FIGURE 16 - PENCIL HEATER

TEMPERATURE SENSOR

Figure 13:
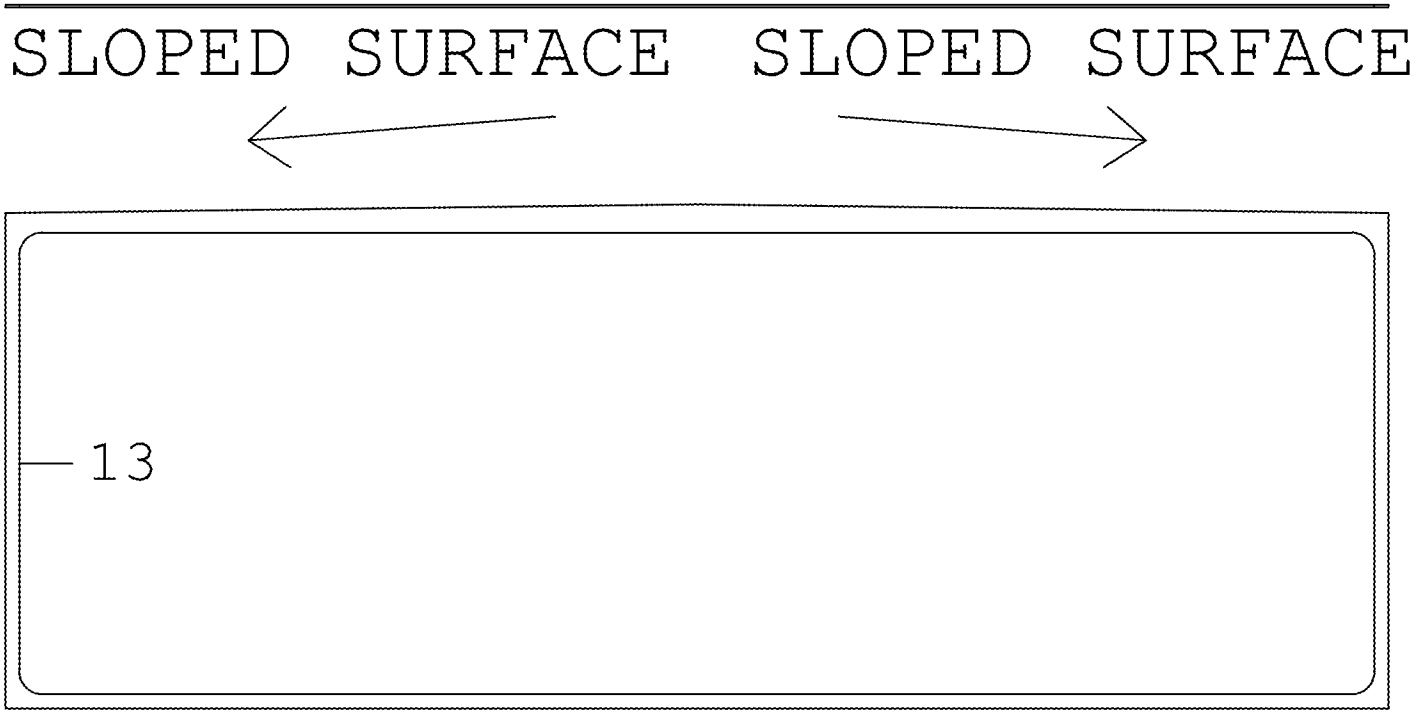
Figure 14:
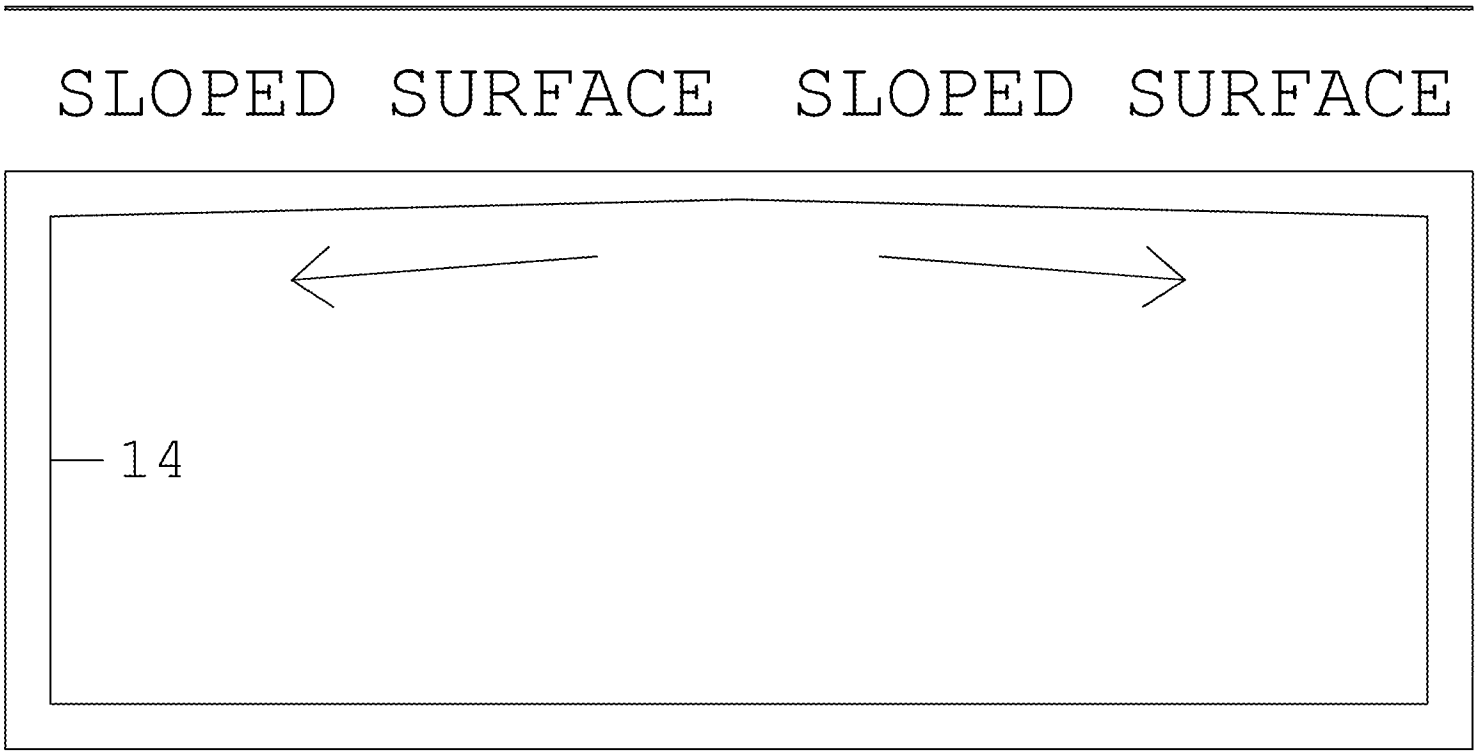

L-SHAPE BENT TO FORM FIGURES 14 AND 21.
THE SLOPED FIGURE 7 WELDED TO THE TOP AND SEAL WELDED
21
14
7
21
7
14
SECTION B-B
B
B
18
Z-SHAPE BENT TO FORM THE COMBINATION
OF FIGURES 7, 14 AND 21.
COMBINATION OF - FIGURES 7-14-21
INNER COMBO SLEEVE - FIGURE 18

COMBINATION OF - FIGURES 15 & 22
OUTER COMBO SLEEVE - FIGURE 19

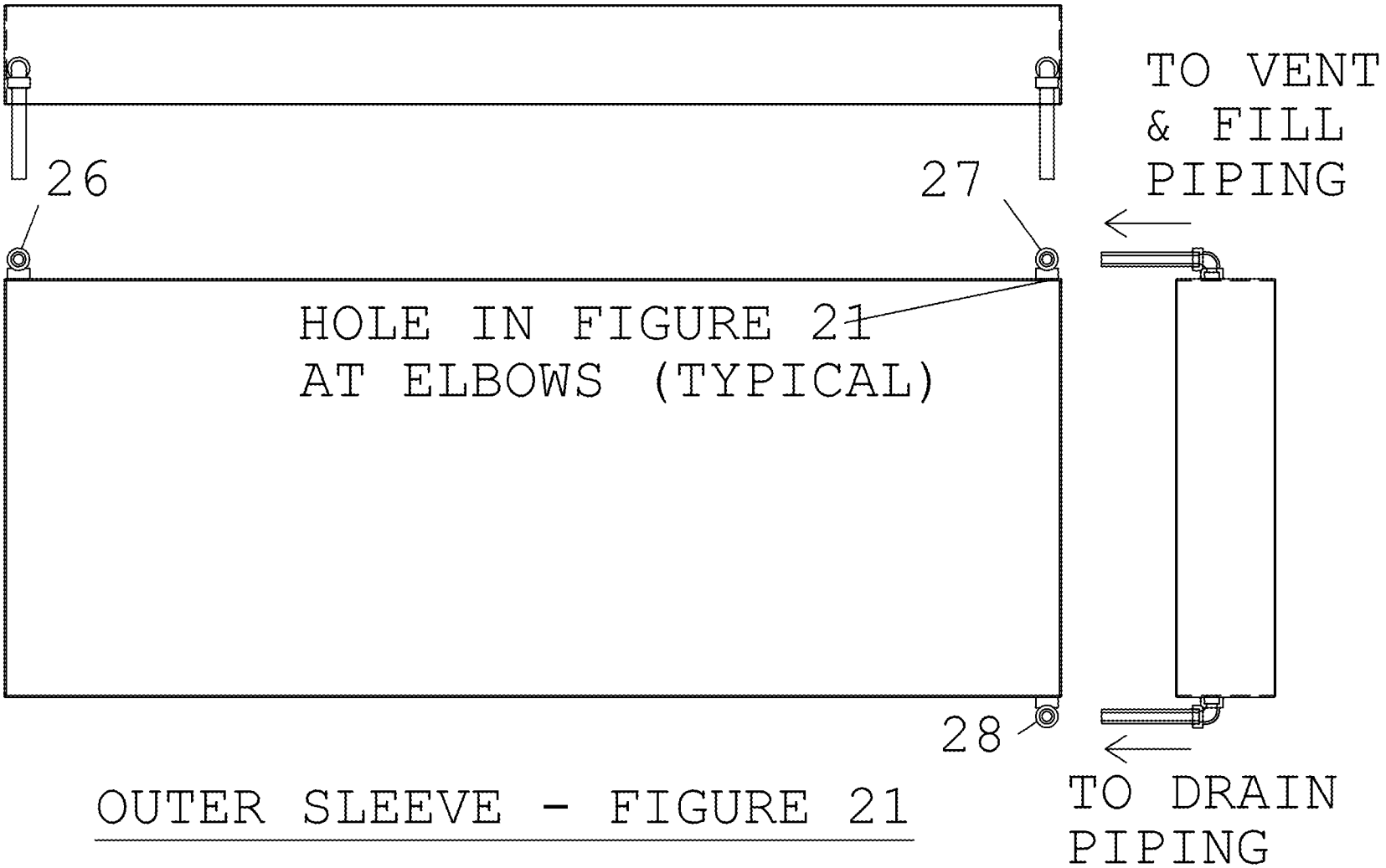
OUTER SLEEVE - FIGURE 21

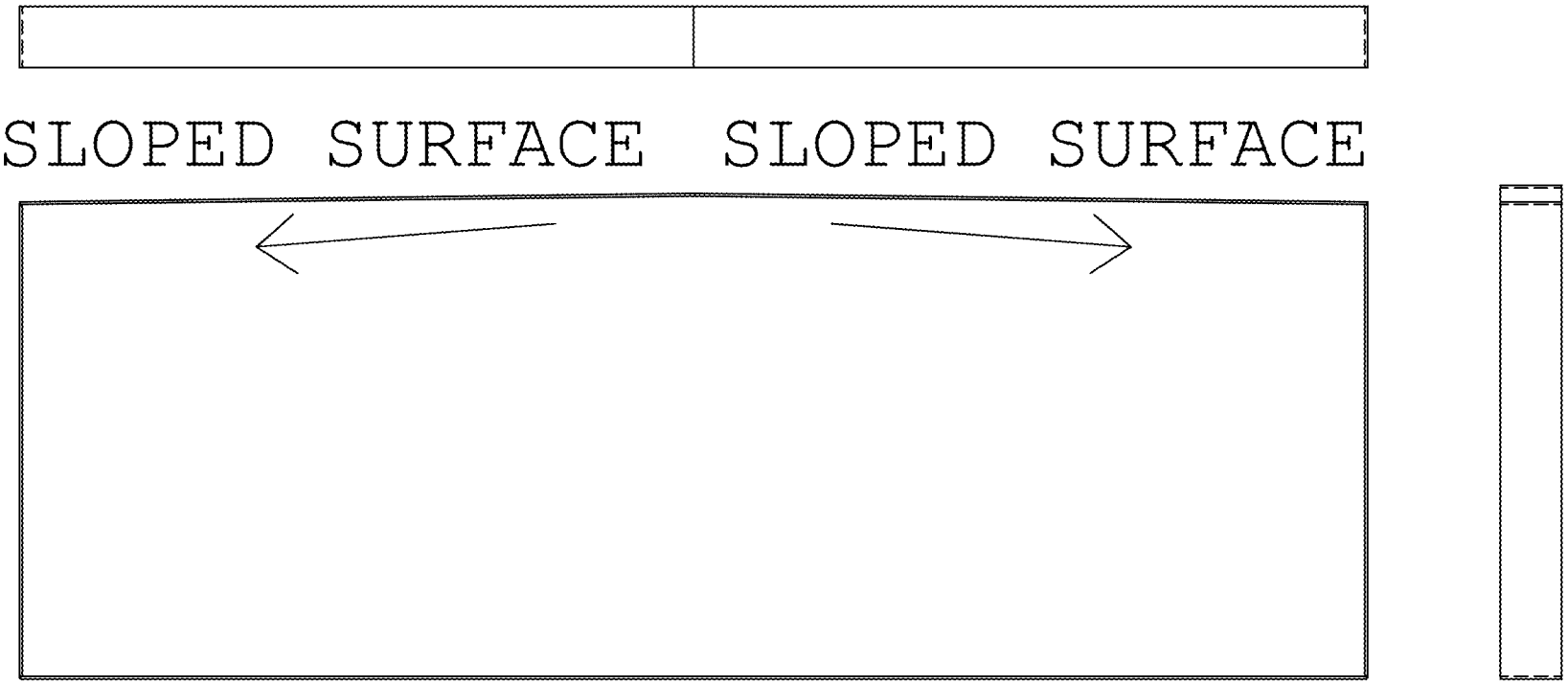
OUTER SLEEVE - FIGURE 22

Figure 5:
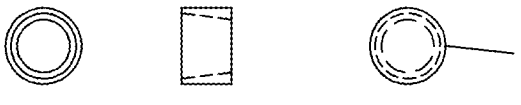
Figure 6:
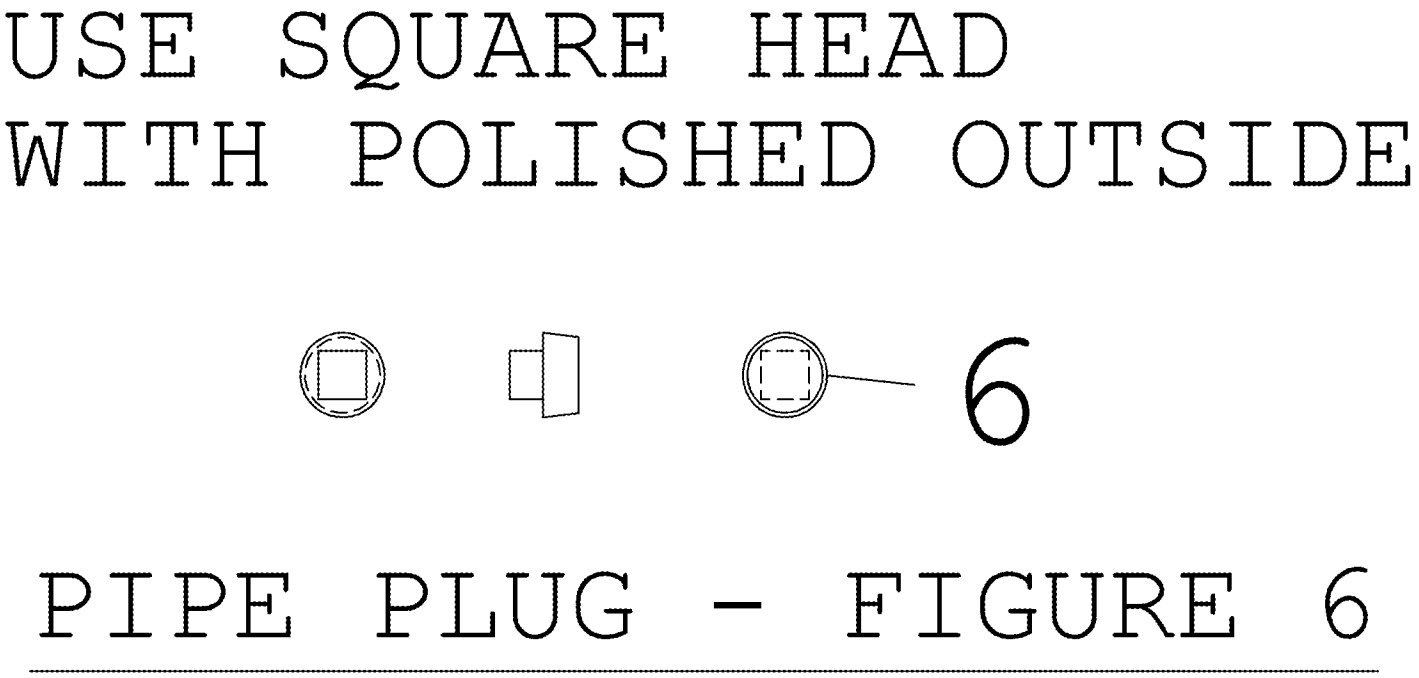
Figure 8:
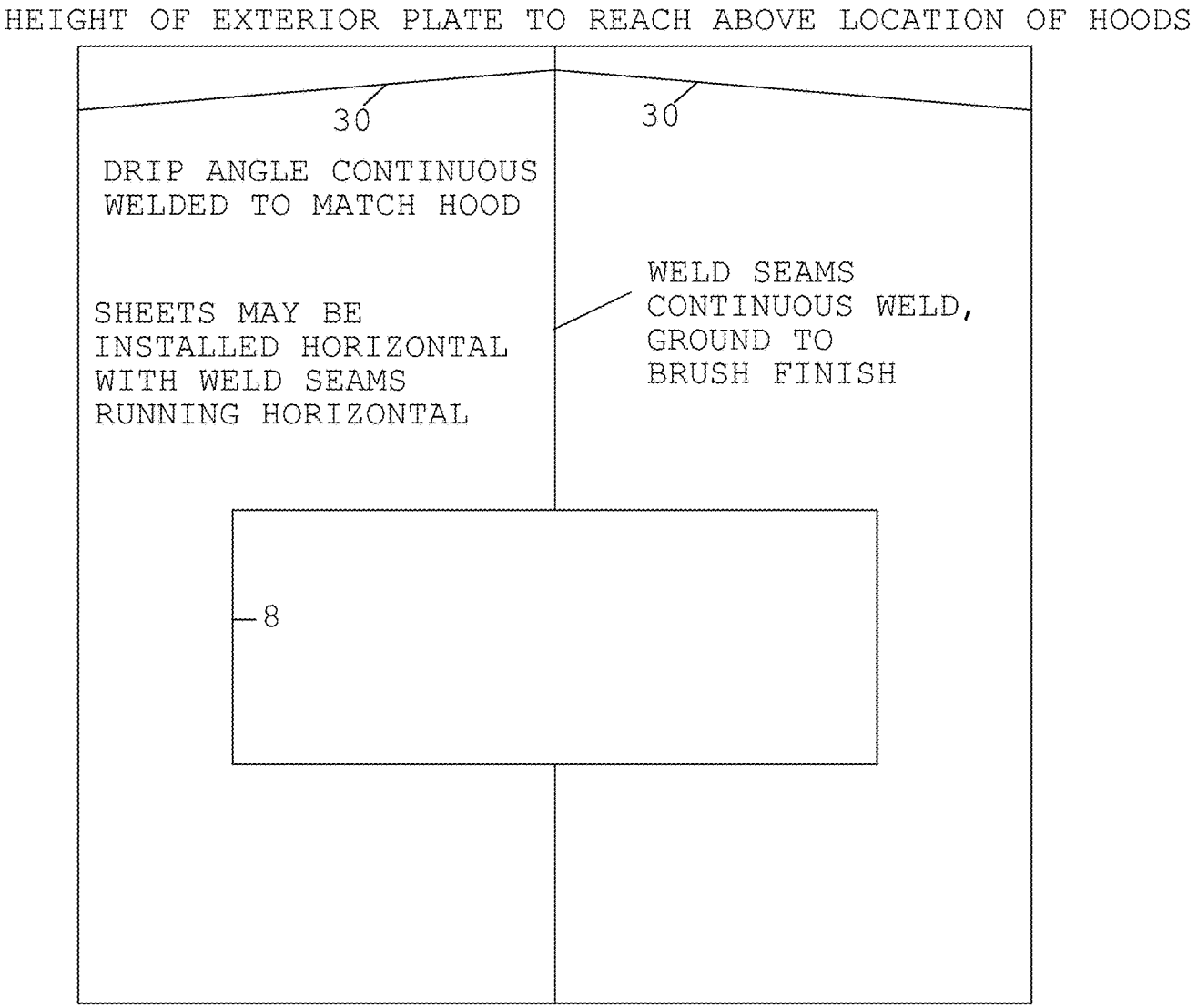

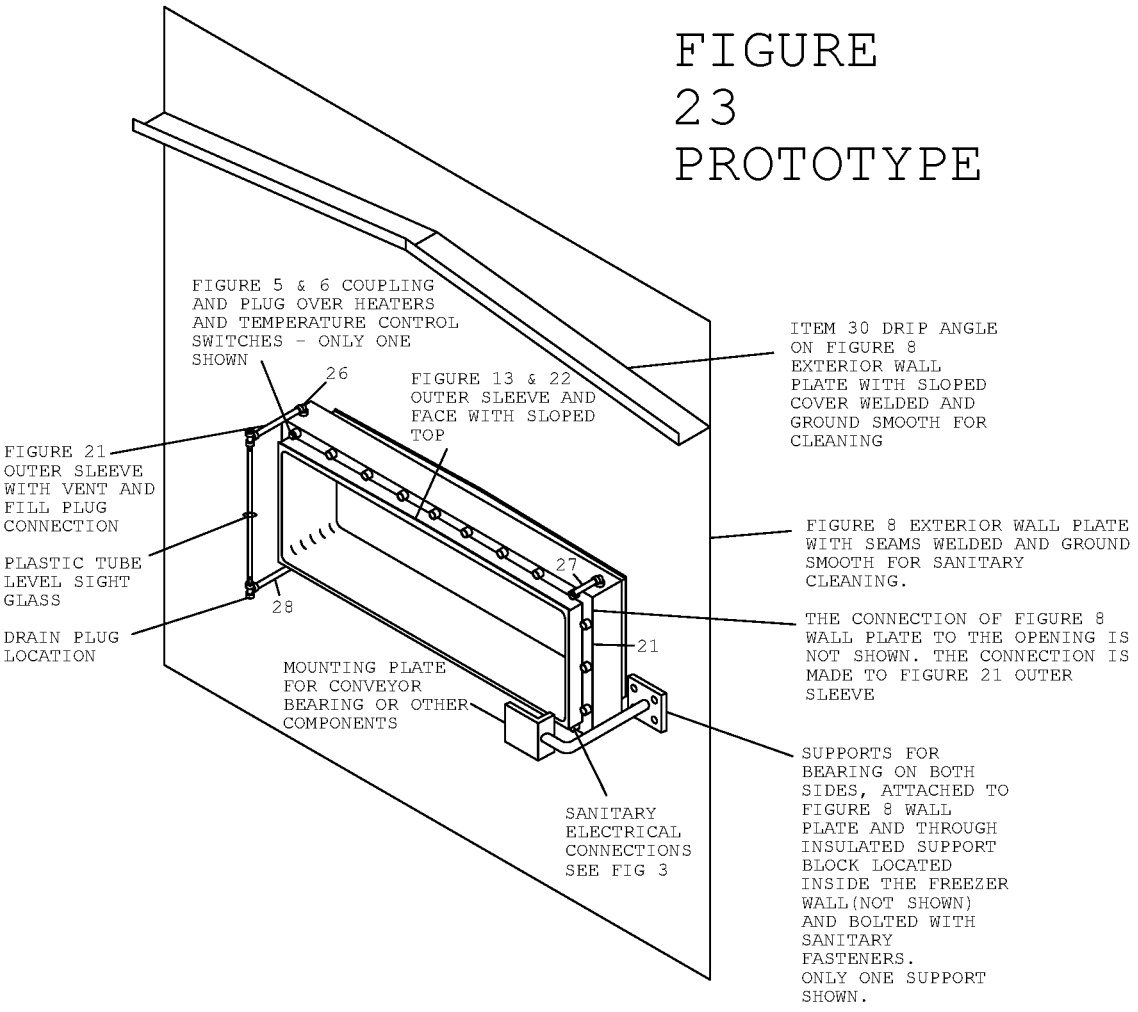
FIGURE 23 PROTOTYPE
FIGURE 5 & 6 COUPLING AND PLUG OVER HEATERS AND TEMPERATURE CONTROL SWITCHES - ONLY ONE SHOWN
26
FIGURE 13 & 22 OUTER SLEEVE AND FACE WITH SLOPED TOP
ITEM 30 DRIP ANGLE ON FIGURE 8 EXTERIOR WALL PLATE WITH SLOPED COVER WELDED AND GROUND SMOOTH FOR CLEANING
FIGURE 21 OUTER SLEEVE WITH VENT AND FILL PLUG CONNECTION
PLASTIC TUBE LEVEL SIGHT GLASS
DRAIN PLUG LOCATION
28
27
21
FIGURE 8 EXTERIOR WALL PLATE WITH SEAMS WELDED AND GROUND SMOOTH FOR SANITARY CLEANING.
THE CONNECTION OF FIGURE 8 WALL PLATE TO THE OPENING IS NOT SHOWN. THE CONNECTION IS MADE TO FIGURE 21 OUTER SLEEVE
MOUNTING PLATE FOR CONVEYOR BEARING OR OTHER COMPONENTS
SANITARY ELECTRICAL CONNECTIONS SEE FIG 3
SUPPORTS FOR BEARING ON BOTH SIDES, ATTACHED TO FIGURE 8 WALL PLATE AND THROUGH INSULATED SUPPORT BLOCK LOCATED INSIDE THE FREEZER WALL(NOT SHOWN) AND BOLTED WITH SANITARY FASTENERS. ONLY ONE SUPPORT SHOWN.

FIGURE 24 - CUT OUT IN FREEZER WALL WITH SUPPORT BLOCK IN PLACE
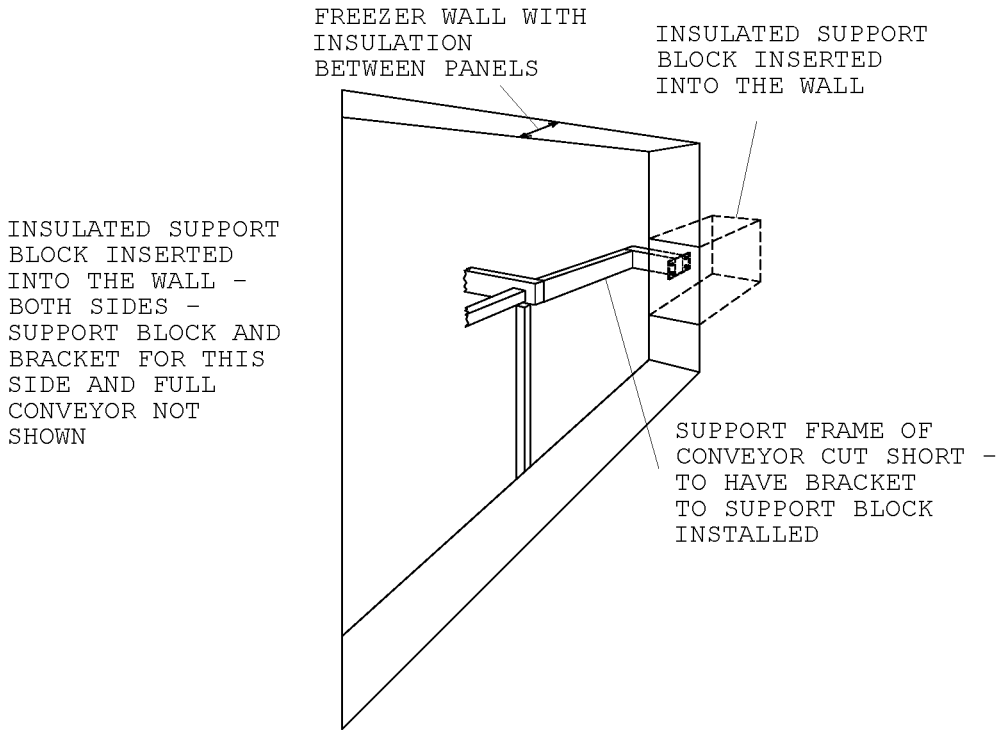

Figure 20:
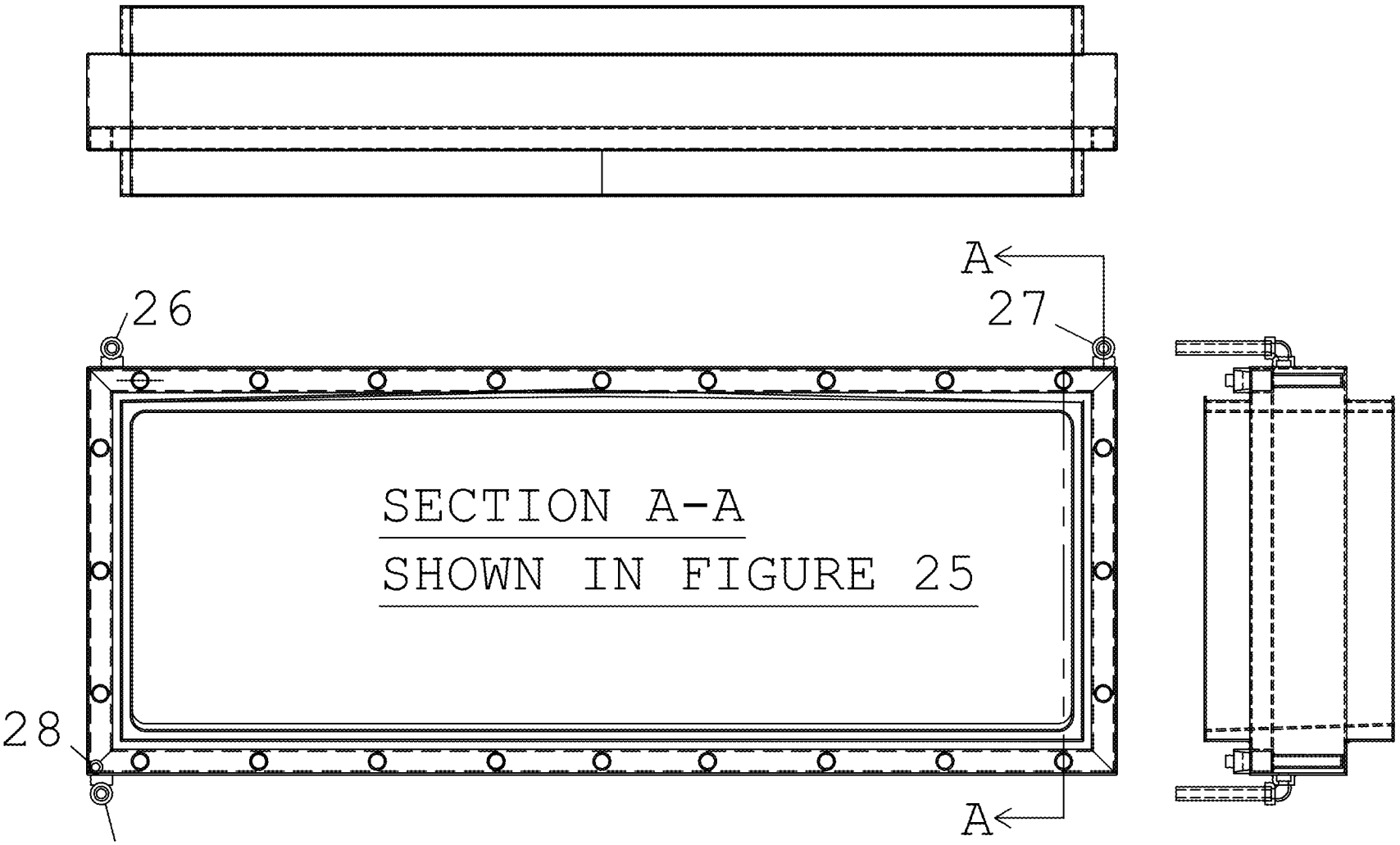

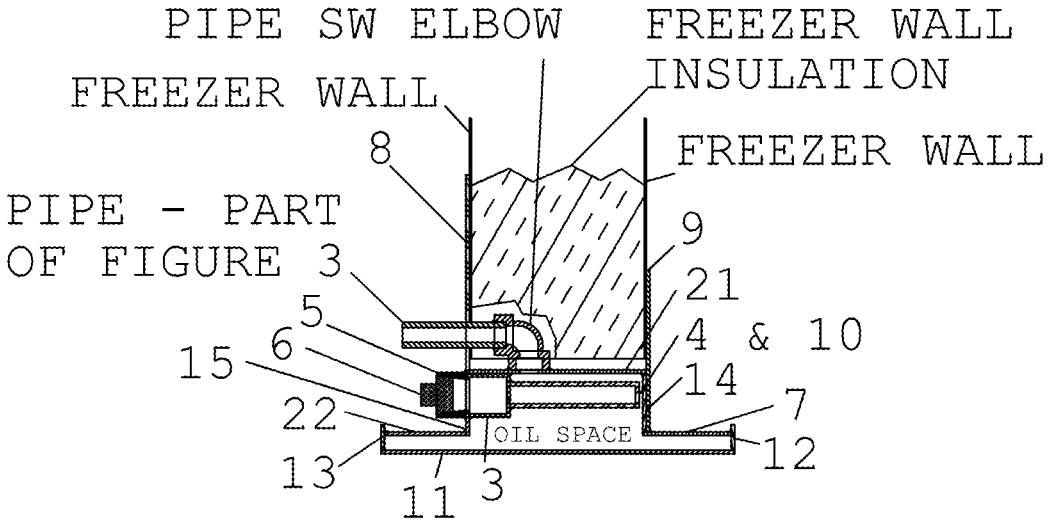
SECTION A-A OF FIGURE 20
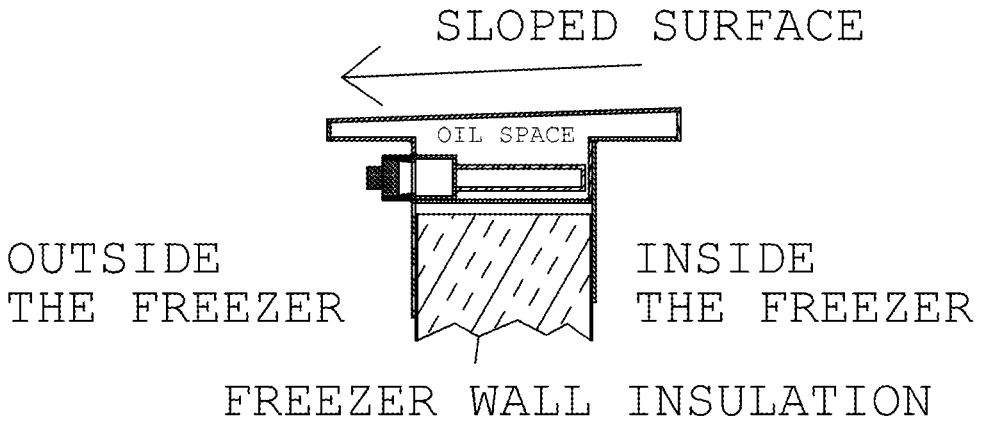
FIGURE 25
WALL OF FREEZER

REFRIGERATED ENCLOSURE OPENING AND METHODS

CROSS-REFERENCE TO RELATED APPLICATIONS

This application claims the priority of U.S. Provisional Patent Application 62/756,530; Refrigerated Enclosure Opening and Methods, Filing date: Nov. 6, 2018; and incorporated into this application by reference.

STATEMENT REGARDING FEDERALLY SPONSORED RESEARCH OR DEVELOPMENT

Not Applicable/Not Federally sponsored.

REFERENCE TO SEQUENCE LISTING, A TABLE, OR A COMPUTER PROGRAM LISTING COMPACT DISC APPENDIX

Not Applicable/No compact discs.

BACKGROUND OF THE INVENTION

The Field of the Invention

The refrigerated enclosure opening generally relates to a continuous refrigeration cooling or freezing device. These enclosures are typically used in the cooling of product in an industrial setting. IE: This opening would be very useful in freezers used for manufacturing food and that continuously transfer the food through the freezer enclosure via a conveyor belt(s). This invention is for an opening where the passage is continuously open. The conveyor belt passes through the inlet opening with product on it, the conveyor spends time inside the freezer where the product is cooled, and then the conveyor and cooled product leaves the enclosure through an outlet opening. The refrigerated Enclosure opening could be used in cryogenic cooling and freezing systems to reduce or eliminate frost and condensation at openings.

Condensation reduction that does not compare well to this invention is sometimes used for door surfaces or inside surfaces of enclosures that are not continuously open such as found with a home refrigerator and/or home freezer door or lid.

Condensation reduction that does not compare well to this invention is sometimes found for the periodic use on refrigeration coils inside the freezer, these often use hot gas from the refrigeration circuit as a heat source.

Some freezer manufacturers utilize balance fans in attempt to reduce the air flow through the openings, but this is ineffective at elimination of condensation. These designs do not compare to this invention.

The use of air with moisture removed and blown across the opening has also been used to reduce condensation. The drying process to remove the moisture is very expensive to operate and equipment needed is very expensive to purchase and install. Often this design is ineffective and unreliable at elimination of condensation at the opening. These designs do not compare to this invention.

There is not an invention found for the reduction or elimination of condensation or frost on conveyor supports, or similar devices that are located near the opening.

BACKGROUND REFERENCES (NONE ARE COMPARABLE TO THIS INVENTION)

| Item | Patent Number | Date of Filing |
|---|---|---|
| 1 | (European) EP 1 335 170 A1<br>Int Class: F25D 21/04; F25D 23/08 | 20 Jun. 2002 |
| 2 | (U.S. Pat. No.) 4,192,149<br>Int Class: F25D 21/06<br>US Class: 62/151; 62/176A; 62/273; 62/277 | Sep. 18, 1978 |
| 3 | (U.S. Pat. No.) 4,192,150<br>Int Class: F25B 47/00; F25B 41/00<br>US Class: 62/277; 62/513 | Jun. 24, 1976 |
| 4 | (U.S. Pat. No.) 5,778,689<br>Int Class: H05B 3/84<br>US Class: 62/150; 62/248; 219/218 | May 19, 1997 |
| 5 | (U.S. Pat. No.) 6,141,984<br>Int Class: F25D 21/06<br>US Class: 62/275; 62/248; 220/826; 220/827; 220/840; 220/841; 220/842; 220/524 220/523 | Sep. 16, 1998 |
| 6 | (US) 2008/0104973 A1<br>Int Class: F25D 21/00<br>US Class: 62/80; 62/140 | Mar. 13, 2007 |
| 7 | (US) 2006/0130514 A1<br>Int Class: F25D 11/02<br>US Class: 62/446; 62/441; 62/443 | Dec. 14, 2005 |
| 8 | (U.S. Pat. No.) 8,302,764<br>US Class: 198/778; 198/850 | Nov. 6, 2012 |
| 9 | (U.S. Pat. No.) 6,155,060<br>Int Class: F25D 17/06, F25D 23/00<br>US Class: 62/94; 62/271; 62/272 | Dec. 5, 2000 |

BRIEF SUMMARY OF INVENTION

Technical Problem

This invention is unique as it addresses the frost and condensation issues related to all of the surfaces of the enclosure opening as well as the component pieces near the opening. It is unique as it addresses an opening that does not have a closure, such as a door or window. It is unique in the method to use a heated fluid that transfers the heat evenly and efficiently to all surfaces of the opening and that allows temperature control of the fluid temperature and thus the surface temperature. It is unique in that the heating elements can be easily replaced without significant disassembly or effort. It is unique in that there are no moving parts and should have little to low cost maintenance required.

This invention is unique in that is does not need to control air flow in and out of the opening and also does not need to condition the air around the opening. This invention is effective as it is easy to adjust and reliable to reduce condensation when there are variations in freezer or room conditions. This invention is effective and does not use complicated equipment that are very difficult to sanitize, and take a very long time to take apart and put back together after cleaning.

Frost and condensation on surfaces have been identified as an issue to prevent at the open passages of enclosures. In food manufacturing the need to design equipment that has the ability to be cleaned and sanitized is critical to prevent food contamination, often called a sanitary design. Guidelines from United States agencies such as FDA and USDA are increasingly more stringent. This problem at open passages has been a recent focus for the food industry and can cause significant costs in labor as well as plant downtime for removing the frost and condensation at the open passage. If the condensation or frost returns quickly, the ability to productively run the line is compromised because it may have to be shut down for cleaning. A significant problem to solve is to create a sanitary design that is still easy to clean while eliminating or reducing the formation of frost and condensation. The technical solution needs to be cost effective in fabrication, low cost in periodic maintenance, reliable so that expensive repairs are not likely, and be easy to clean with minimal time needed; all of which are provided by this invention's design and also the invention is useful for many hundreds of installations both existing and new.

This invention is a novel use and combination of components that is unique in the use of heated oil in an annular space, with efficient heat transfer from easily serviced heating elements, and with temperature control of zones of the annular space which allows for high efficiency. Overheating is not energy efficient and can be eliminated as each zone can be set to the needs of that zone. The novel use of food grade oil eliminates concerns for food contamination from the oil. This invention's design allows for fabrication to provide surfaces that are easy and effective to clean.

BRIEF DESCRIPTION OF DRAWINGS OF THE INVENTION

Figure 1:
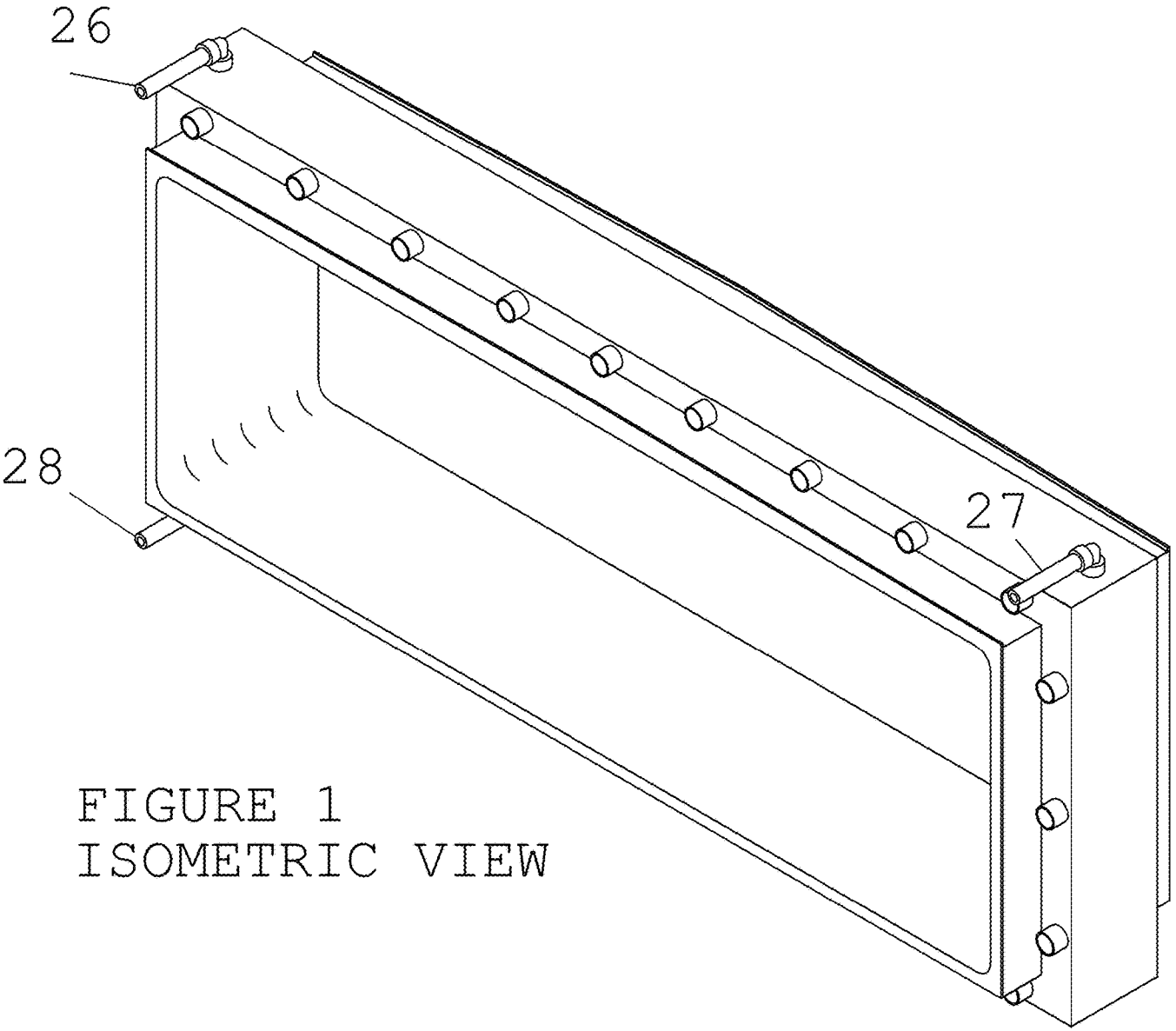

These features and aspects of the invention, as well as its advantages, are better understood by referring to the following descriptions, claims, and accompanying drawings, in which:

FIG. 1: The refrigerated enclosure opening is shown by an isometric view. The opening fits into a hole cut through the wall or other surfaces of a larger refrigerated enclosure.

Figure 2:
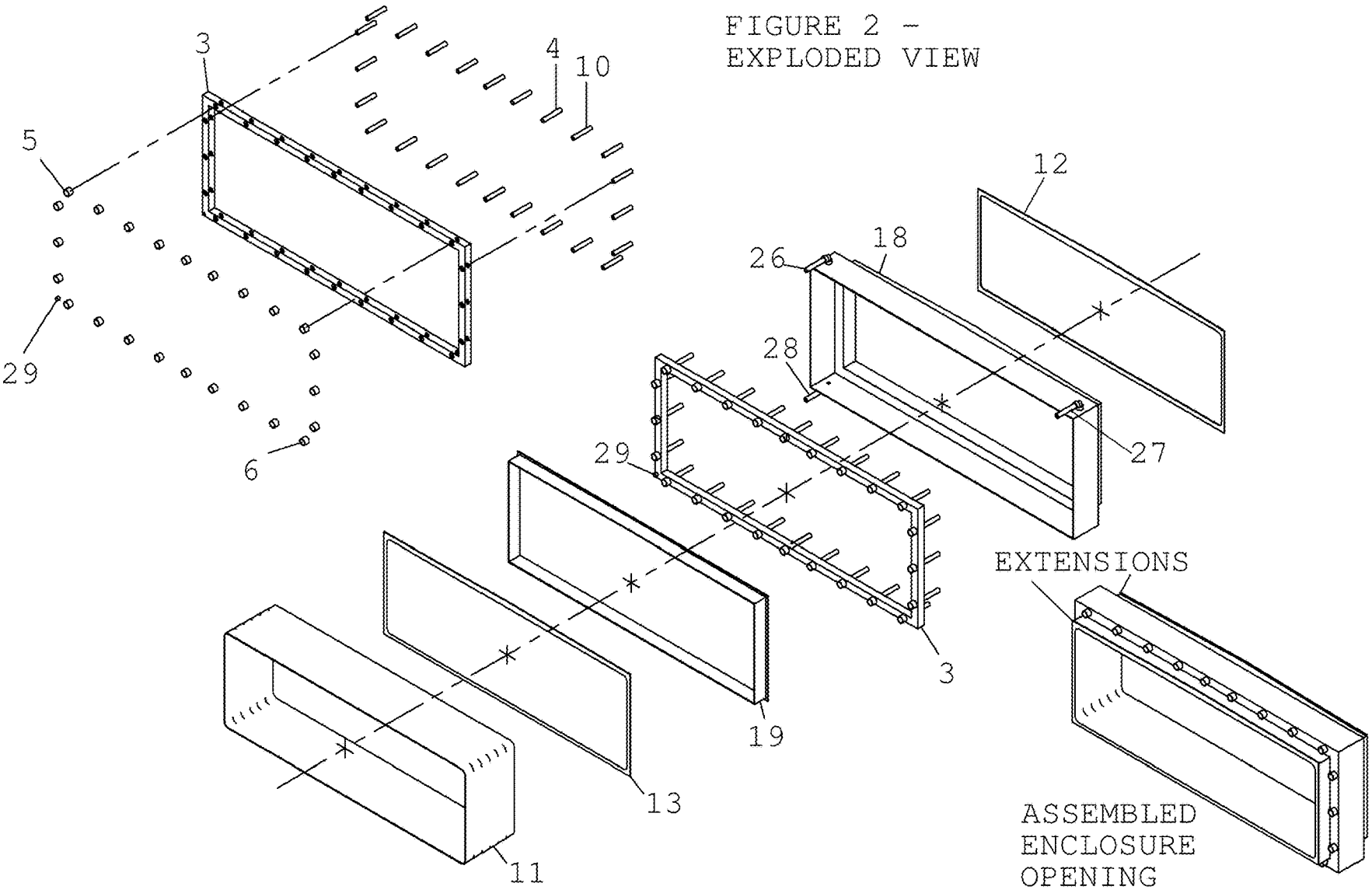

FIG. 2: The refrigerated enclosure opening is shown by an exploded view of components.

Figure 3:
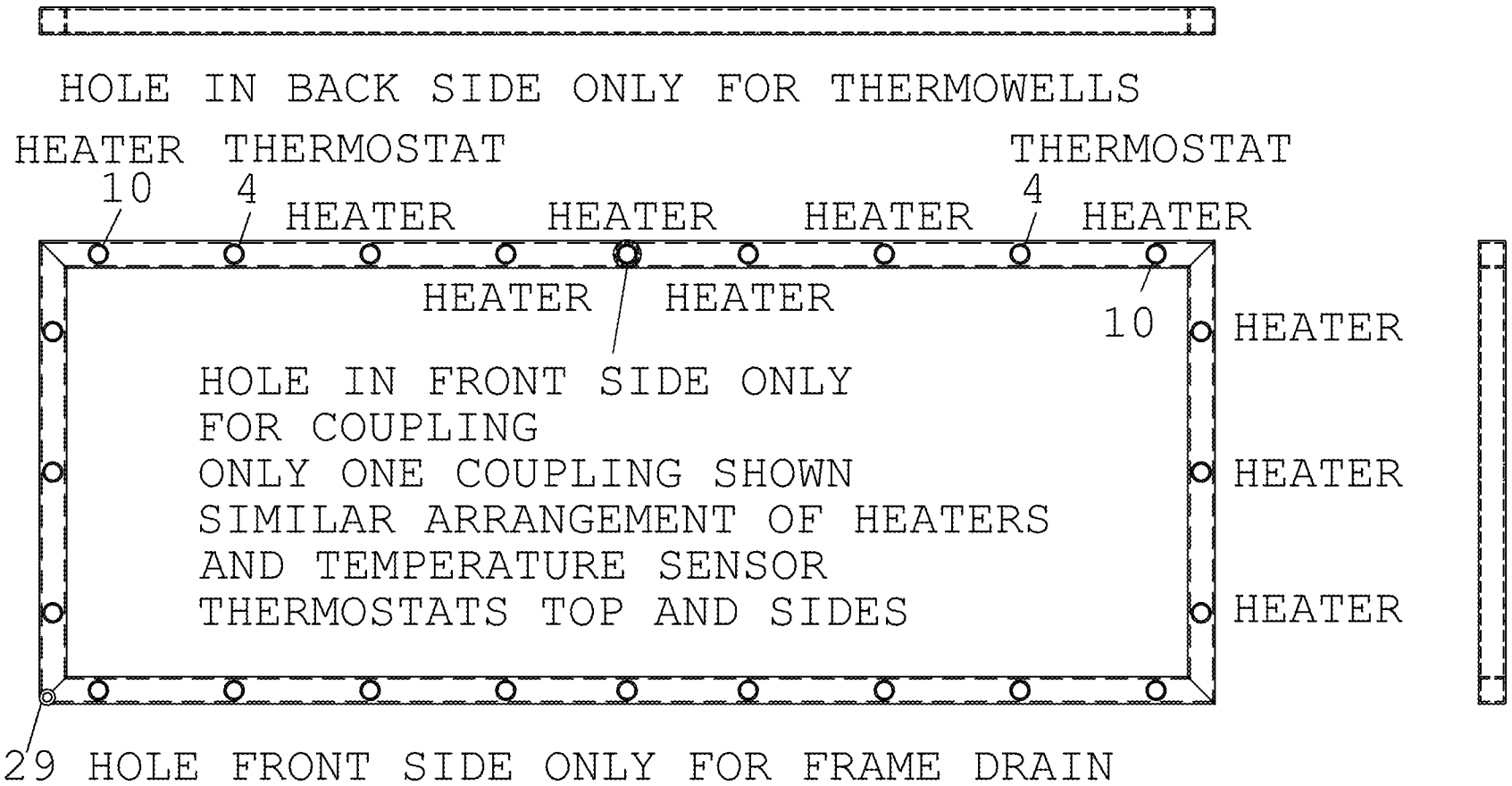

FIG. 3: this is a top, front, and side view of the tube frame that holds the thermowells, access port couplings, also fill, vent, and drain piping. This figure shows one possible orientation for heaters and thermostats.

Figure 4:
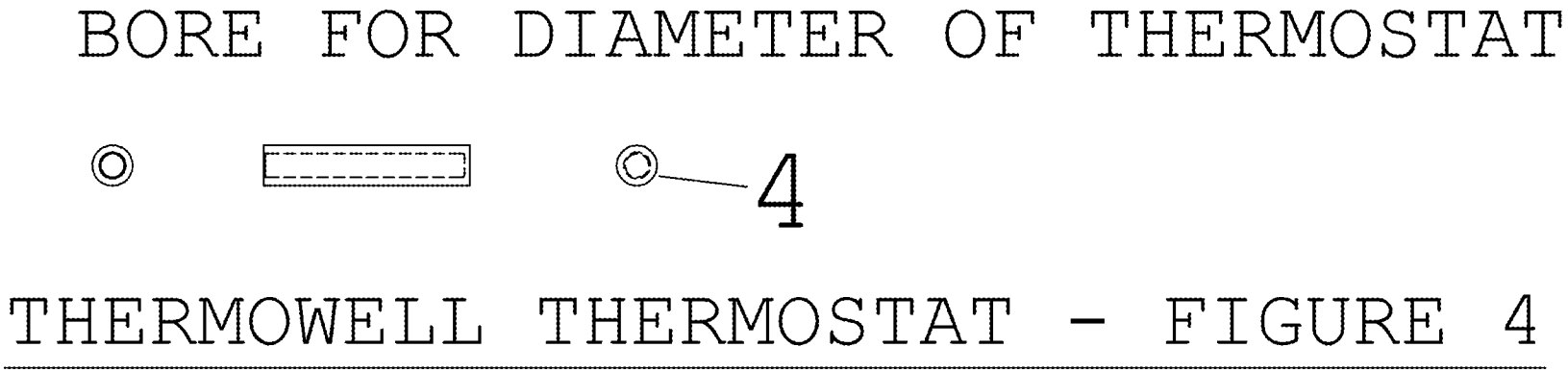

FIG. 4: this is a front, and two side view of the thermowell for the temperature control thermostat element.

FIG. 5: this is a front, and two side view of a pipe half coupling.

FIG. 6: this is a front, and two side view of a pipe plug.

Figure 7:
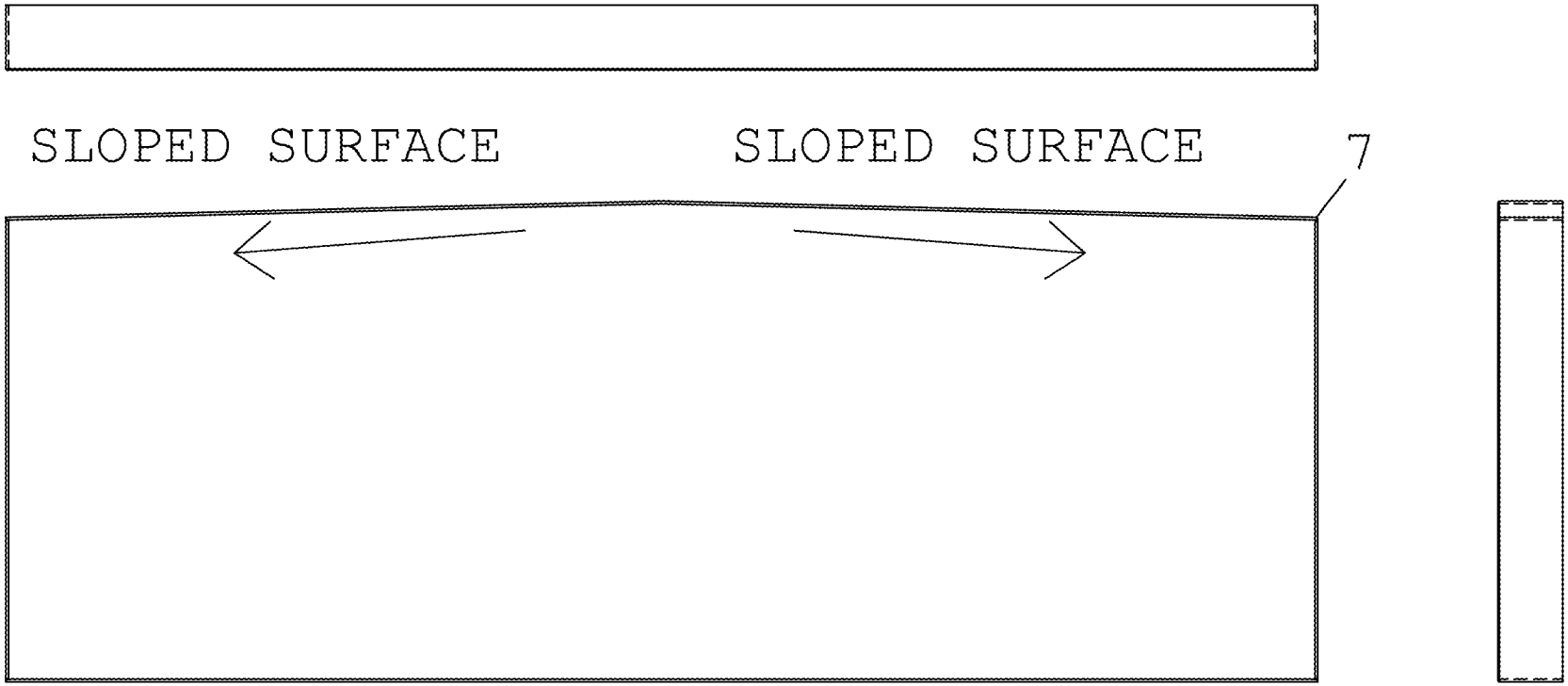

FIG. 7: this is a front, side, and top view of an Inner Sleeve that is part of the opening assembly.

FIG. 8: this is a front, side, and top view of the Exterior Wall Plate. It shows a drip angle installed.

Figure 9:
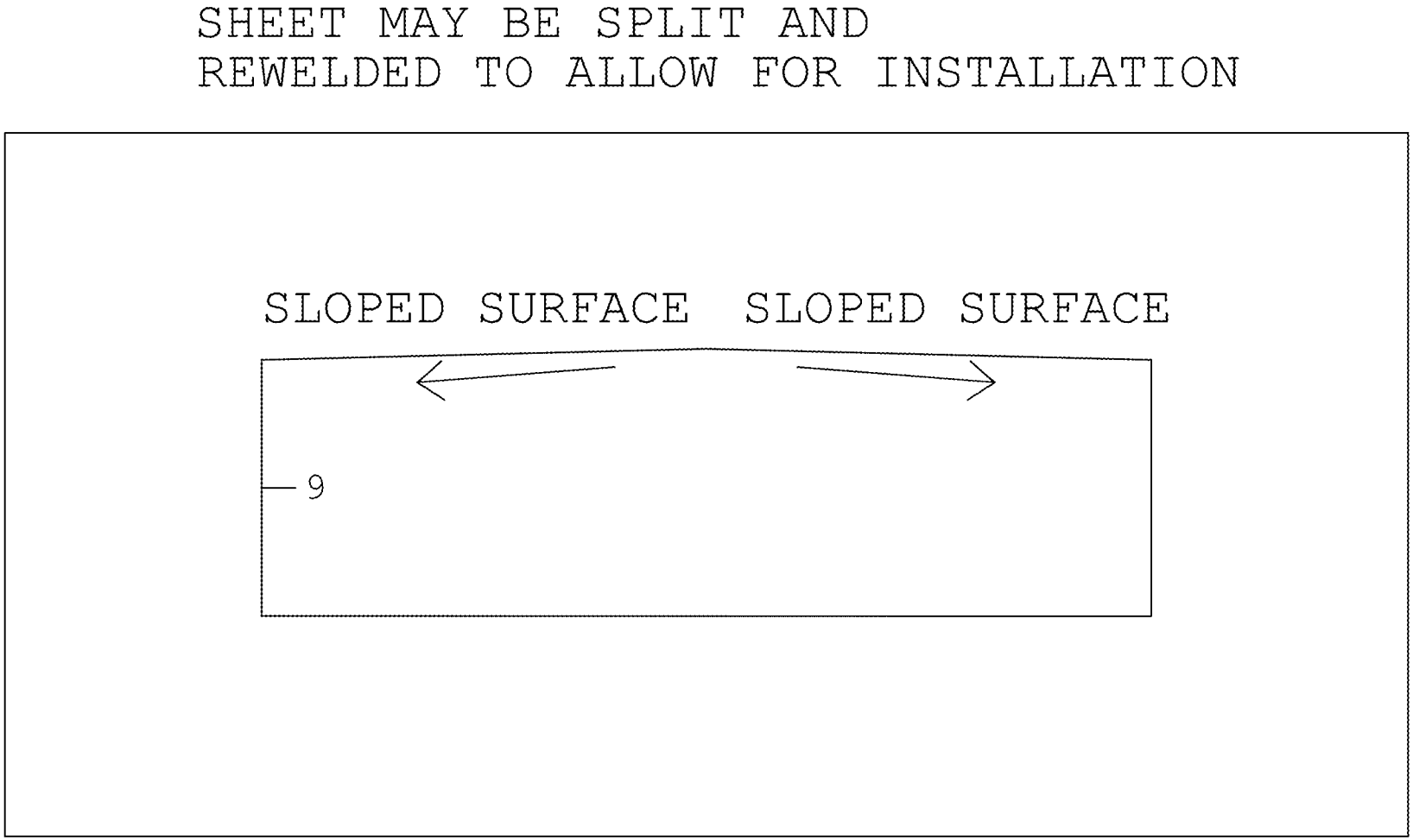

FIG. 9: this is a front, side, and top view of the Interior Wall Plate.

Figure 10:
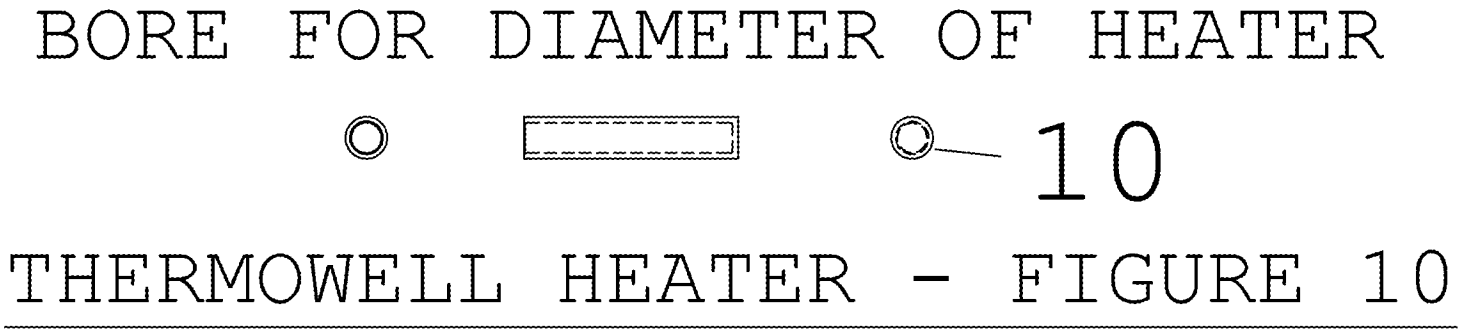

FIG. 10: this is a front, and two side view of the thermowell for the temperature sensing element with thermostat.

Figure 11:
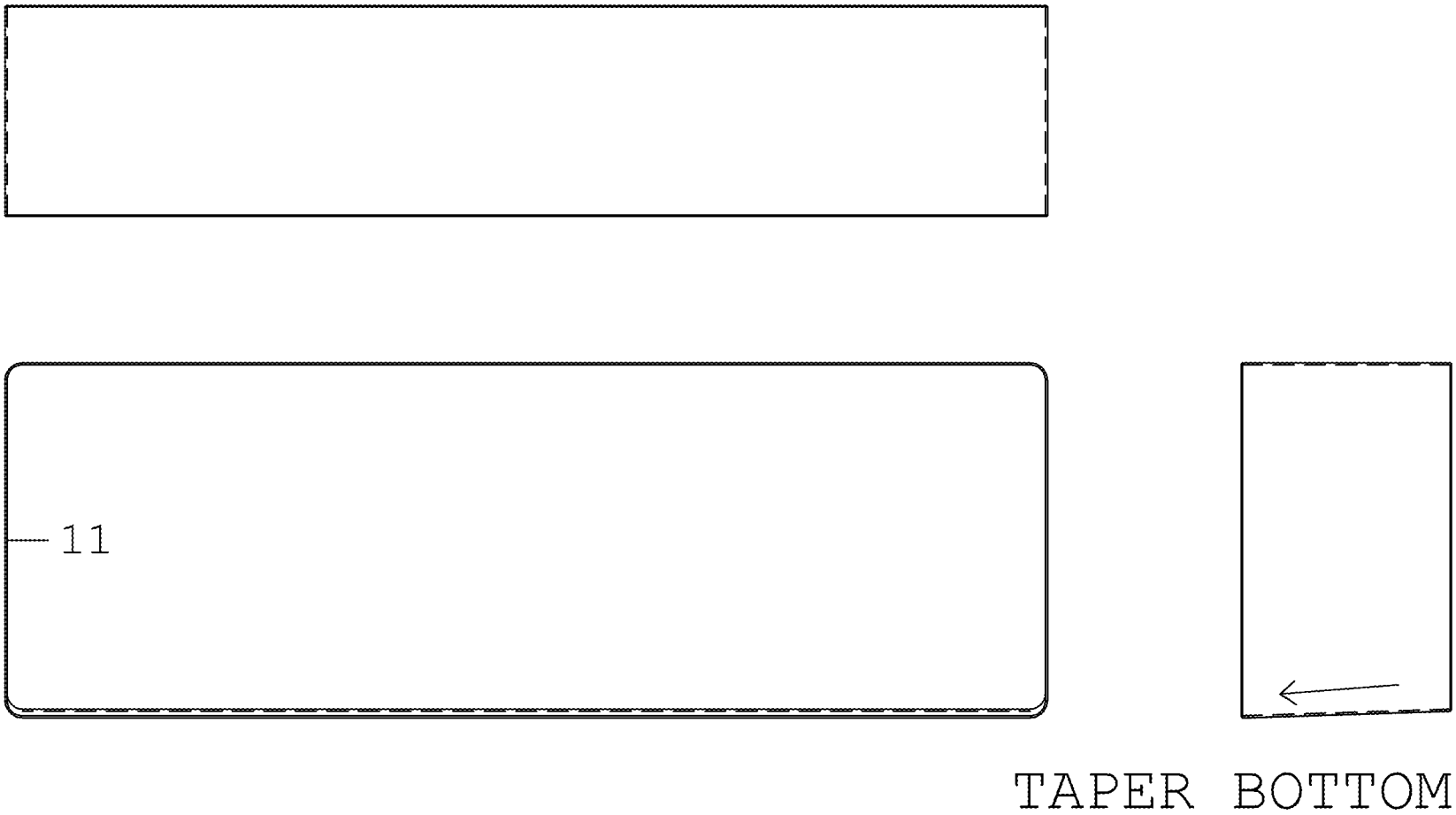

FIG. 11: this is a front, side, and top view of a sleeve that makes up the main passage through the wall.

Figure 12:
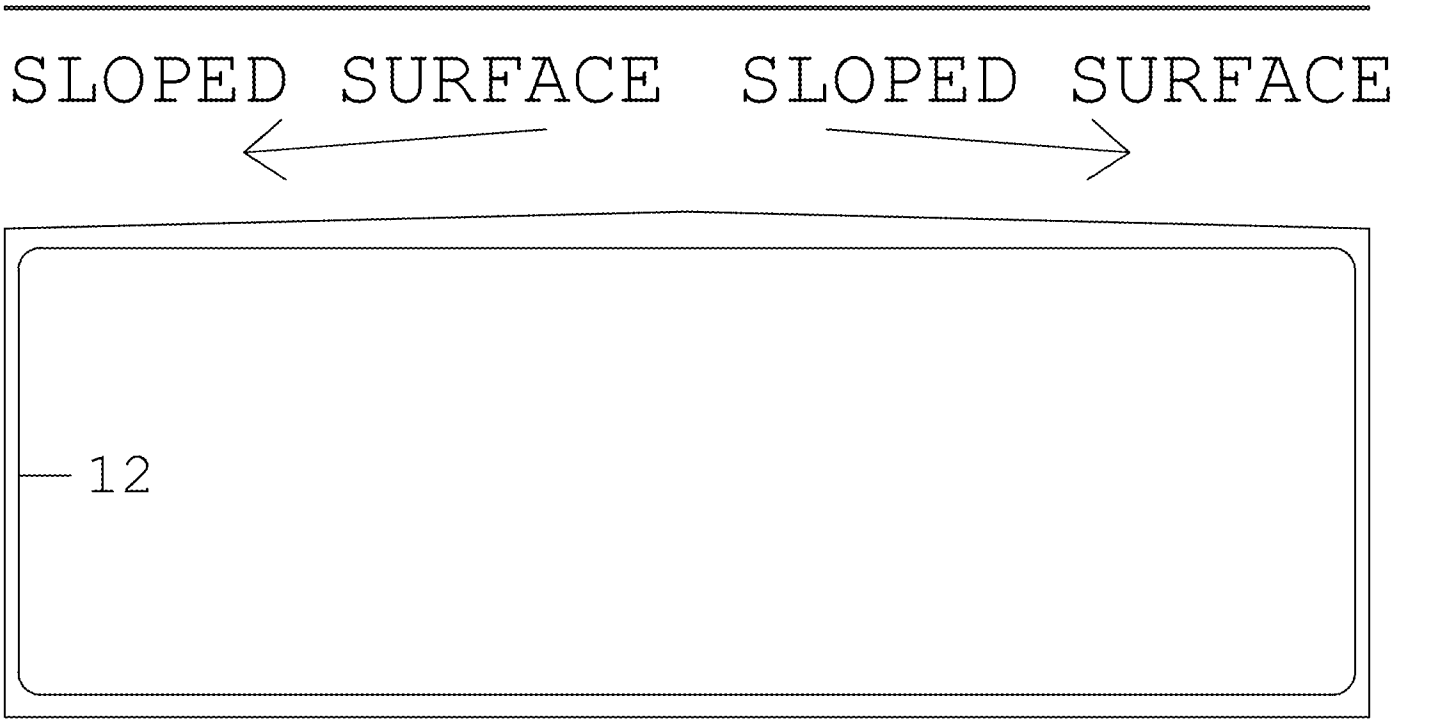

FIG. 12: this is a front, side, and top view of an inner sleeve face.

FIG. 13: this is a front, side, and top view of an outer sleeve face.

FIG. 14: this is a front, side, and top view of an interior plate.

Figure 15:
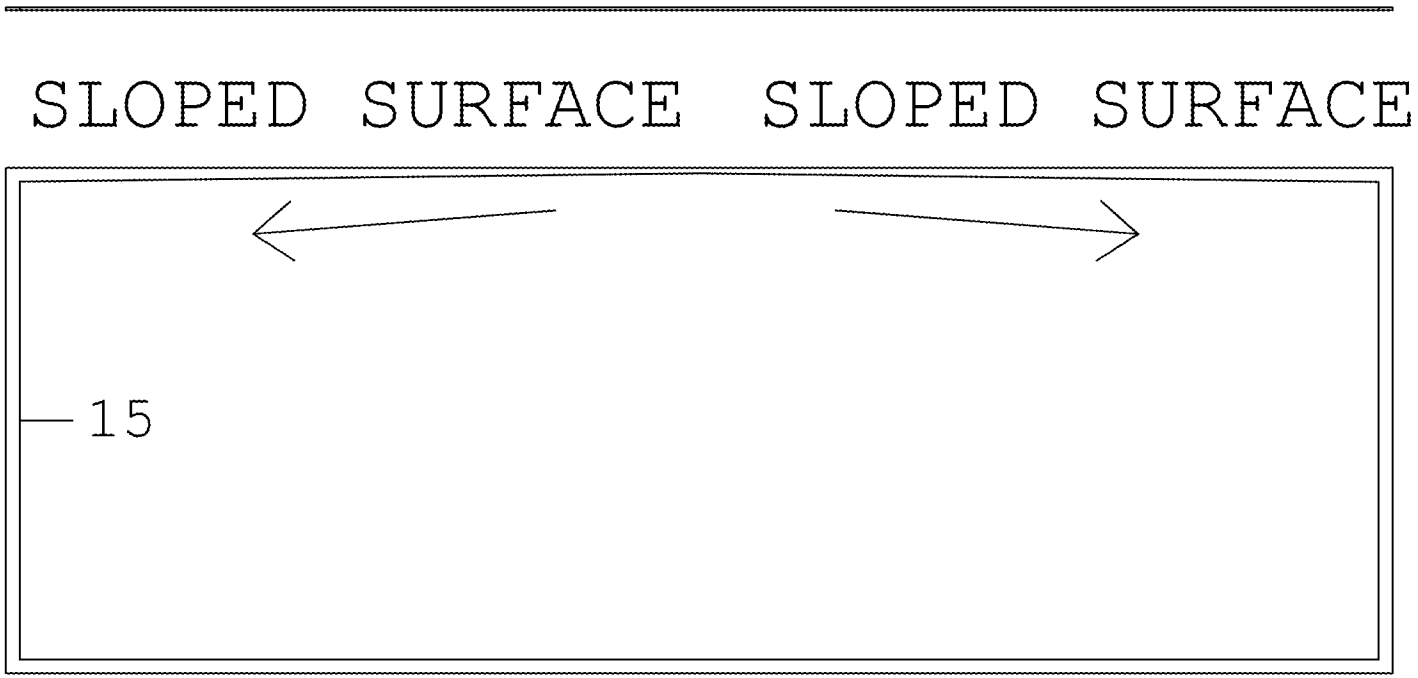

FIG. 15: this is a front, side, and top view of an outer plate.

Figure 16:
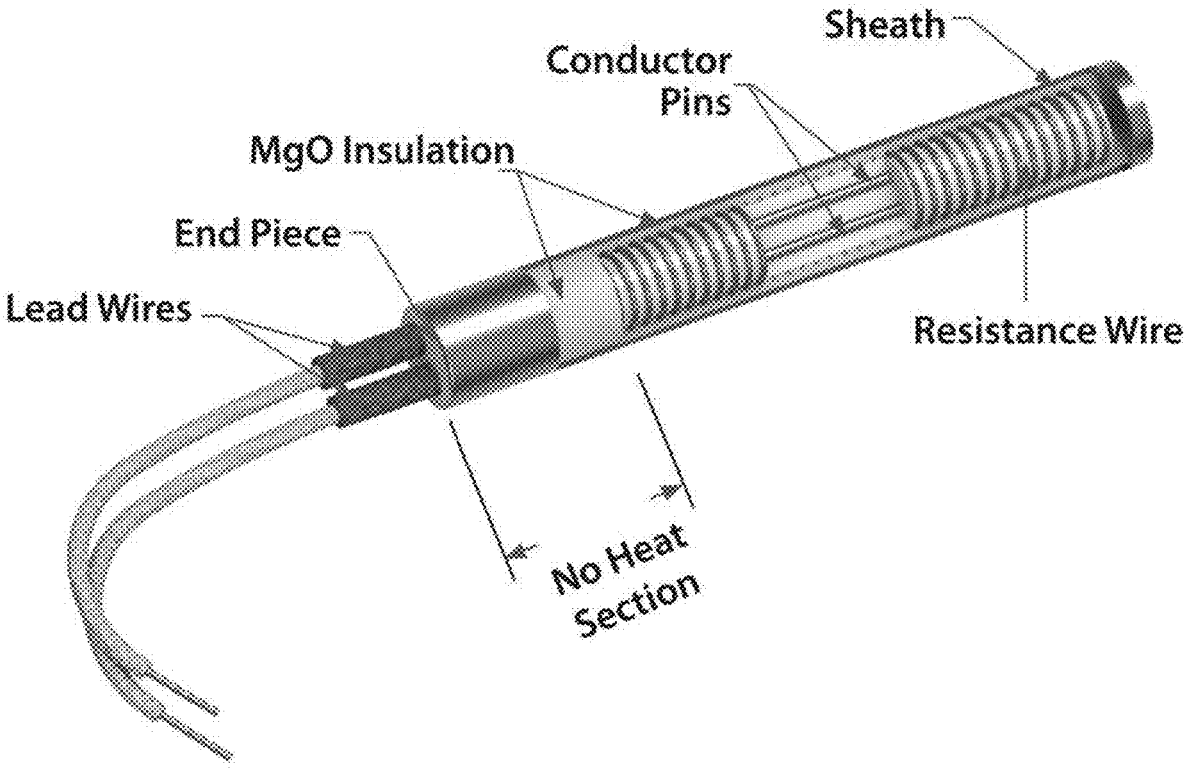

FIG. 16: this is a drawing for a pencil heater.

Figure 17:
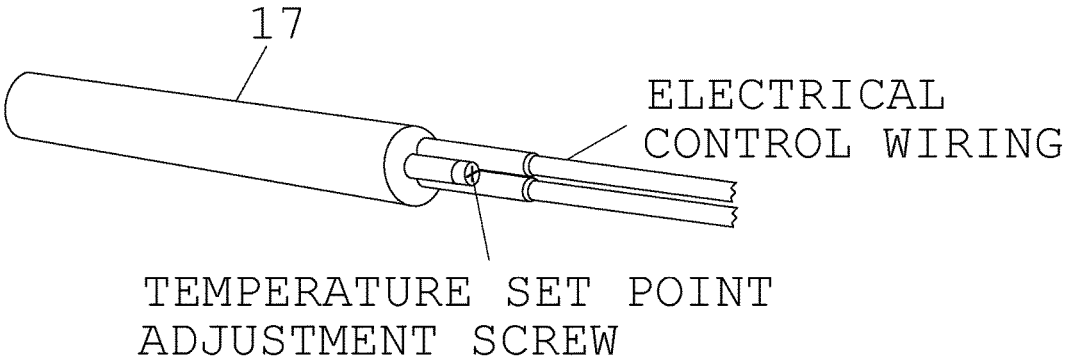

FIG. 17: this is a drawing for a temperature sensor with thermostat.

Figure 18:
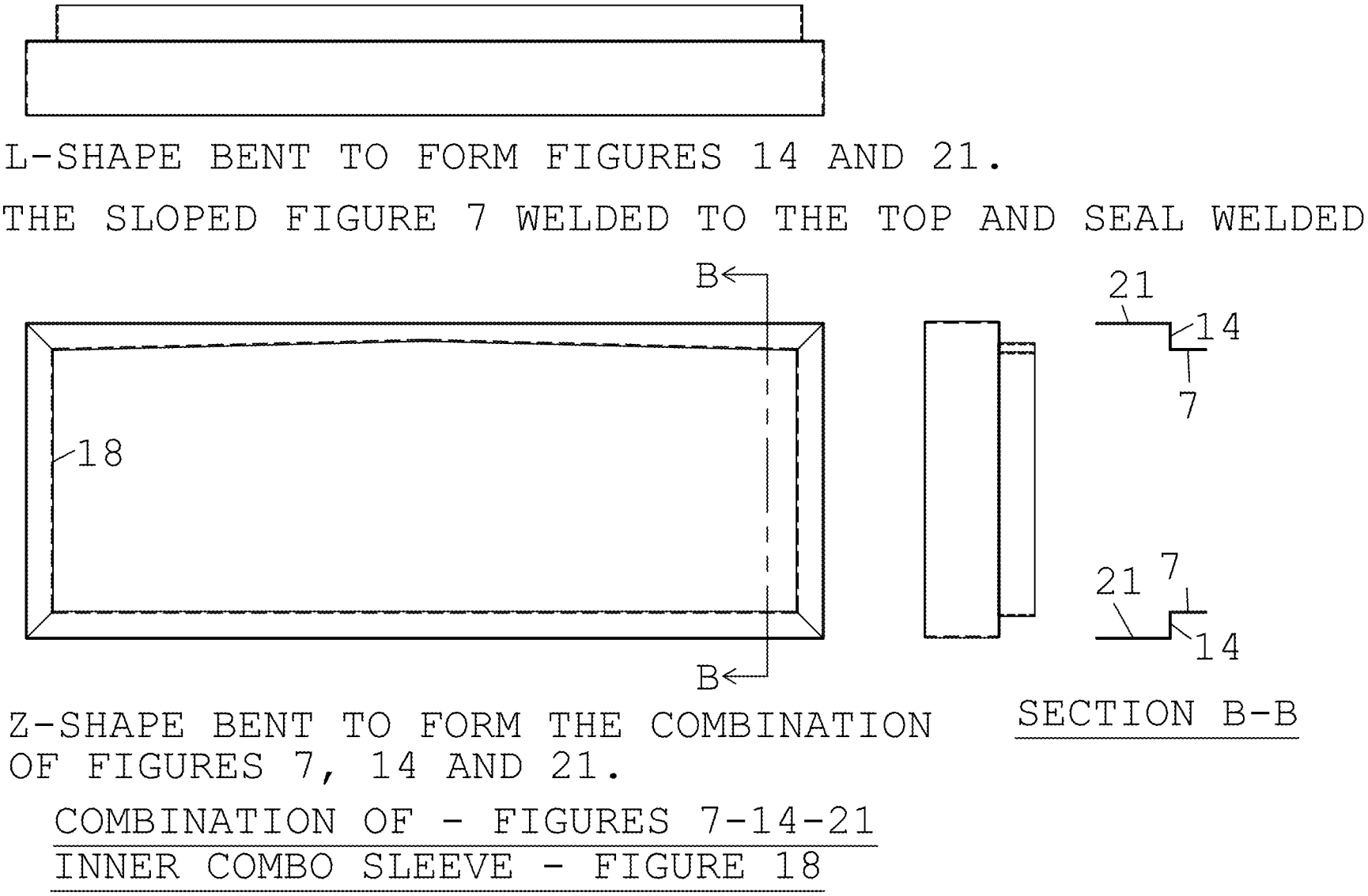

FIG. 18: this is a front, side, and top view of a combination of three FIGS. 21, 7, and 14; to make one piece with less welding required.

Figure 19:
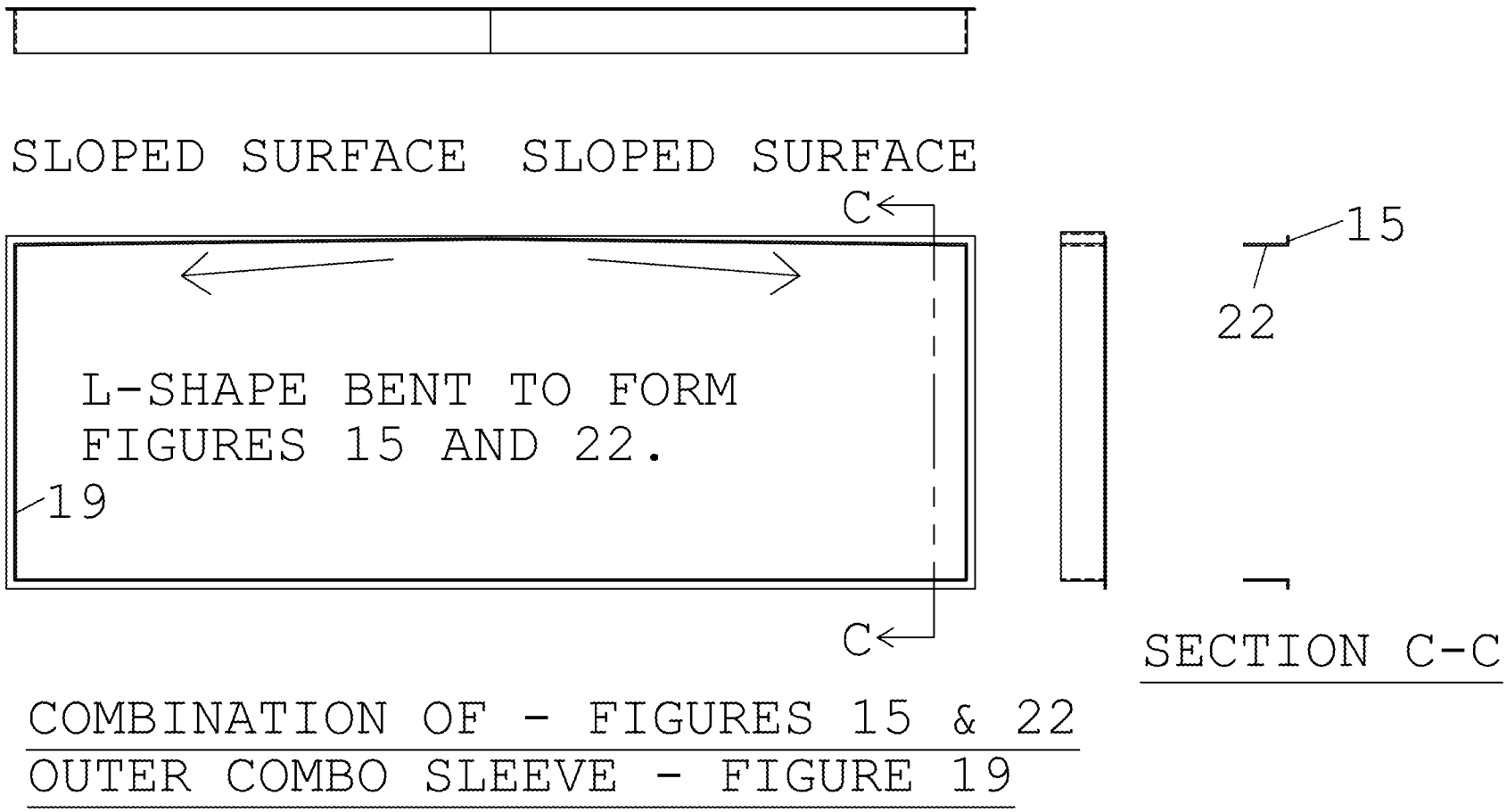

FIG. 19: this is a front, side, and top view of a combination of two FIGS. 22 and 15; to make one piece with less welding required.

FIG. 20: this is a top, front, and side view of the complete assembled opening, less the wall panels. A cross section showing the relationship of assembled parts including the wall panels is shown on the figure and detailed on FIG. 25.

FIG. 21: this is a front, side, and top view of an outer sleeve.

FIG. 22: this is a front, side, and top view of an outer sleeve.

FIG. 23: this is a picture if an installed prototype mounted in a freezer wall.

FIG. 24: this is a picture of the freezer wall prepared for the installation of support block and enclosure opening.

FIG. 25: this is a cross section of the enclosure opening detailed on FIG. 20.

DETAILED DESCRIPTION OF THE INVENTION

Terms Used

The word "wall" or "walls" alone will be used later in this explanation of this invention, and they are meant to include floor and ceiling openings.

The word "frost" will be used alone and is meant to include ice, snow, condensation, dew, droplets, mist, moisture, fog and other synonyms. The frost and condensation are from water vapor in the air around the opening that deposits on the opening when the vapor is below the dew point. Depending on the process the vapor could be other than water.

The word "freezer" will be used alone to describe the enclosure that is around any refrigerated space. It will be used to include both coolers that have above water freezing internal air temperatures and freezers with below internal air temperatures.

The word "oil" is used alone to describe the fluid used inside the opening of the annular space and what is transferring the energy from the heaters to the surfaces of the opening. The fluid can be a heated liquid or a heated gas vapor.

The word "microbiological" is used alone to describe virus, bacteria, and toxins that are harmful when found in food. This term includes all debris and products that need to be cleaned from the surface.

Technical Solution (Refers to this Invention or this Solution)

A unique heated opening passage through the walls, floor, or ceiling of a refrigerated enclosure. Refer to FIG. 1. An opening that is heated above the dew point of air around the opening and in the opening.

Several components or designs are combined to provide the unique assembly. Refer to FIG. 2. Components A through H are described later.

Alternatives will include many variations that are for the component and also for the combination of components. It is possible to only use one component and not any others. All combinations of components are feasible to be assembled as a solution.

This solution is very useful as it can be installed into most existing freezers and incorporated into new freezers. This is very useful as there are hundreds of freezers in use in the world. It may not be necessary to modify the existing equipment on the inside and outside of the freezer. IE: balance fans may be used with minimal or no modifications.

This solution is unique as it does not significantly add energy (load) to the freezer. Temperature controls reduce the energy used to the minimum needed to prevent frost or condensation.

This solution is unique and useful as it allows evaluation of overall energy usage of the freezer system. If balance fans or similar are presently used, the heated opening may eliminate the need for balance fans or other expensive to operate humidity control systems used with the freezer system. The energy needed for internal balance fans could be eliminated, and the fan energy may be more than that required for the heaters of the opening. Similarly, if presently used, elimination of a circulated dry air humidity control system will likely mean considerable energy and maintenance savings. Elimination of balance fans and dry air humidity control ducting would significantly reduce the sanitation time required to clean the fans and ducts to and will improve the ability to sanitize while reducing labor and chemical costs.

This solution does not need to control the air flow through the opening. Air flow can have unwanted bacteria or debris that can get onto the product passing through the opening so that it is undesired. This solution does not try to control the dew point of the air that is supplied to or at the opening area. Because this solution is not affected by air flow or dew point variations, it provides a frost free surface when both air flow and dew point change. This solution is a significant unique improvement over other attempts to reduce frost at the openings. Air flow used with other solution attempts is affected by many items and is nearly impossible to efficiently control because the variations occur very frequently. Once the variation occurs the frost can form and may not easily go away on its own. IE: A person passing through a door from one room to the next can change the flow through the freezer. IE: Refrigeration changes during coil cleaning can change the air flow pressures and flows inside the freezer. IE: Seasonal changes that create more or less humidity in the air around the opening as well as daily changes in temperatures and humidity from day to night.

This solution can be uniquely and easily adjusted by temperature sensor to reach a temperature where frost does not form in the various zones. The sensor can be adjusted slightly higher to accommodate for variations. A slightly higher temperature promotes the sublimation and evaporation of any frost or liquids that reach the surface. Once adjusted higher, it should not need to be adjusted again. If significant changes occur, such as a failed air conditioner in the room that causes abnormal temperatures and humidity, the temperature settings can be adjusted easily until abnormal conditions are remediated.

This solution allows for a surface finish of the assembly to be provided on the components that can be sanitized during the cleaning process with relative ease. This solution design removes sharp internal corners and calls for smoothing welds so that microbiological growth can be eliminated and prevented. The metal surface can be polished or bead blasted depending on the need of the process and sanitary design specifications.

This solution provides a unique design with an extension ledge and lip on both sides of the wall that will keep frost from dropping onto the interior surfaces of the opening and also onto any items passing through the opening. FIG. 23 shows the installed opening with FIGS. 13 and 23 extending from the surface of the wall. IE: food products passing through the opening on a conveyor will not have frost or debris easily falling on them from above. The ledge extension reduces the direct impact of air flows to the walls around the opening. When the air does not impact the wall directly, it eliminates or reduces the formation of frost at the opening. Because there is heat transfer from the opening to the extension, there is further reduction of frost formation.

The extension ledge can be combined with external hoods and covers to reduce chances of food contamination. Refer to FIG. 8. The ledge prevents a direct path of drips and debris to fall from above, and that is an important requirement for a sanitary design.

The extension ledge shown in FIG. 23 is sloped to the sides from the middle to direct liquids to the sides during normal use and during sanitation. Any liquids or debris will be directed away from the top of the opening and to a location where periodic cleaning can easily be accomplished.

The ledge has a lip on it that prevents the flow down the channel from flowing over the face of the ledge extension.

This solution has a sloped surface on the lower surface of the opening, shown in FIG. 25, to allow liquids to flow away and not stand or pool on the surface. The extension ledge allows chutes to be placed under the lower ledge to aid in cleaning.

This solution uses internal frame wiring so that difficult to clean electrical conduits are not needed above the opening.

This solution uses pipe plugs above the access to the heating elements and temperature switches. The location of the plugs allow ease of sanitizing, for access to change out the heating elements, and to adjust the temperature switches. The location of the plugs are behind the extension and warmed by the heaters so that they will not easily have frost form on them.

This solution has a unique design to use insulating blocks at the sides of the opening that are integral with a support frame for a conveyor. The conveyor frame does not pass through the opening and ends before it gets near the wall, as shown in FIG. 24. Frost normally found inside the freezer will stop formation before it gets to the opening. Frost inside the freezer is kept frozen and does not have significant microbiological concerns. Low temperatures inside the freezer are prevented from transferring to the outside of the freezer by the insulation of the block, and prevents frost and condensation formation at the connection on the outside of the freezer wall. The conveyor frame is continued on the outside of the freezer to provide the support for conveyor components. This solution minimizes the amount of frost outside the freezer. The conveyor belt, belt support sprockets/rollers/guides, and shaft will be items with frost on them, and that is similar to items inside the freezer.

Components Used:

Component A: The method of increasing the temperature of the opening is by a heating a fluid (oil) used for heating fryers in a food grade process. The heat is convectively transferred to all surfaces heated by the oil. Convective heat transfer is efficient and reliable, and does not need more expensive and complicated circulation systems. Leaking oil is always possible, so the use of this food grade fluid reduces the chances of contamination of any items around and passing through the opening from the oil.

Alternatives: The fluid used can be anything that transfers the heat from the heating elements to the surfaces of the opening. Alternative oil, fluids, glycols, alcohols, or vapors such as steam or hot gas from a refrigeration system could be used. Fluids that can freeze should be avoided because failure of the heating elements or lack of heating control could cause them to turn to solid. Similarly fluids that could easily vaporize when heated should be avoided because of the expansion of the fluid that would cause.

The opening does not need to have a heated surface. IE: Users may only wish to use the sanitary design and extended sloped surface because the process does not have issues with frost. They may wish to have the opportunity to easily upgrade to the full function of the opening with future process needs. Installation of the opening at the time of new construction should be most cost effective versus retrofitting.

Component B: Electrical heating elements warm the oil. The electrical elements of the pencil style (cylindrical) are inexpensive and easy to replace. Heating elements are turned on and off (controlled) by simple adjustable temperature switches that are also inexpensive, easy to adjust, and easy to replace. When the temperature switch drops in temperature it changes state and turns on the heaters in the zone the heating elements are located. The number of electrical elements used, number of zones of temperature control, spare heating capacity, ability to vary the wattage, ability to vary the location of that heat addition, and available control devices are nearly unlimited with this design.

Four zones are used, top and bottom on both sides. Temperature switches are located near the center of the zone. The failure of one heating element in a zone will not necessarily prevent the heated fluid from reaching the set point of the temperature sensing device control. Redundant amount of heaters and oversized heat output wattage is provided.

Alternatives: The heating elements could be a different shape or type as long as they transfer the heat efficiently into the annular space so that they don't get hot spots and burn out the wire heating elements. There should be a way to easily install and replace them. IE: It is not thought that heat plates or heat tape could be inserted into the annular cavity easily or electrically wired properly, but if that were possible the air inside the cavity might convectively transfer enough heat for some processes. The ability to cover the heat plates or heat tape would be difficult with plates and gaskets/O-rings. It would be difficult to design an efficient sanitary design to cover alternative heating elements that does not need to be taken apart for cleaning.

The heating element could directly enter into the heated fluid. This has the advantage of best heat transfer efficiency. It has a significant drawback of needing to remove the oil around the element when the element needs to be replaced, otherwise there will be an oil leak. IE: The use a screw in base that would allow direct installation through and seal off at the threaded coupling into the heated fluid. Another connection of the heating element to the annular space could be with a flare type fitting that seals around the heating element. O-ring seals using flanged connections could be used with a special design heat element.

The number of heating elements could be increased if lower watt density (lower watt output) elements are used. Lower watt density elements usually last longer as they have less chances of hot spots. A matching number of thermowells would have to be installed.

The use of external heating systems and pumps to circulate fluid through the annular space can eliminate the need for the heating element in the opening. The fluid can be heated by any source of heat instead of using electrical heaters. This has the advantage of removing some of the welding seams, and connections of the pieces that make up the opening, from being inside the freezer wall. Leaks from the inside are reduced because of the elimination of these seams and welded connections. A circulated system will provide better heat transfer efficiency and more uniform heat.

The system could use a pump for circulation to promote heat transfer, and still use the pencil heaters installed in the opening.

Component C: Thermowells are used to insert the heating elements and temperature sensing devices into. Their purpose is to allow for ease of insertion and removal of those devices while not requiring the fluid to be removed from around the thermowell. The heaters could be changed while other elements are still working and hot. The electrical elements of the pencil style (cylindrical) are inexpensive and easy to replace.

The elements fit into the thermowells with heat transfer grease applied. The heat transfer grease helps ensure there are no hot spots.

Alternatives: The thermowell could be a different shape or type as long as they transfer the heat efficiently from the heating element into the annular space so that they don't get hot spots. They need to match the shape of the heating elements closely if the heating element is a high watt density.

The thermowell would not be necessary if a screw in style heating element is used. A common threaded half coupling or as needed to match the threaded connection would replace the thermowell. The fitting welded in the place of the thermowell will have to match the connection of the heating element.

Component D: Heating elements are turned on and off (controlled) by simple adjustable temperature switches that are also inexpensive, easy to adjust, and easy to replace. When the temperature switch drops in temperature it changes state and turns on the heaters in the zone the heating elements are located. The switch energizes an electrical relay that is capable for the amp load of the heating element. The switches are installed in thermowells and behind access plugs.

The heater elements heat output wattage can be revised to adjust for various refrigerated enclosure temperatures and air flows through the openings. Similarly the number of heater elements installed and number of locations to install them can be adjusted to meet conditions found for various enclosures. The locations of heater elements and temperature sensing devices can be moved to achieve more or less zones of heating and also to achieve alternative temperatures on the opening. IE: the wattage, location, and sensing can be changed to achieve lower or higher temperatures in positions on the opening.

The heated elements can be controlled by multiple temperature sensing elements to create zones of heating. The zones of heat can be set independently to allow for unique heat control and thus temperature control of the surface temperature of each zone.

The temperature sensing elements can be set to limit the amount of energy used to prevent frost and condensation from occurring.

The energy use of the heating elements can be evaluated along with energy use of any balance fans to optimize overall total energy use.

The source of heat from electrical devices allows for energy usage sensing from a large number of common devices both portable and permanent.

Alternatives: Electrical heater controls have many options and are nearly unlimited in solutions. The electrical design can be revised for the temperature sensing element to use other than a switch device. Elements that measure the temperature changes and input into a controller are common. Controllers that can be programmed to turn on and off the heating elements are common. Heating elements can be controlled in other ways than an on and off mode. The use of thermowells allows designers many options for items to be used.

A humidity sensor and/or temperature sensor could be added to the control logic to accommodate higher or lower temperature needed to prevent the frost.

It is possible to not control the temperature of the oil. The temperature of the oil could reach whatever the heater wattage creates. Instead of temperature switches, maintained on/off switches could be used. The heaters could be turned on and off so that they are constant on or off. IE: turn on the heaters when the freezer refrigeration is turned on.

Multiple switches, multiple heating elements, and the wattage of the elements would be sized to change the amount of heat provided. The chances of not heating the opening enough or overheating the surfaces are high with maintained on/off design. The chances of overheating the oil is high, and that could cause the oil to break down and form a coating (coke) on the heaters, cause sludge in the oil, and potential vaporization with fires.

Component E: The enclosure opening annular space is made of 316L stainless steel. This is a common material used for fabrication of equipment used in the food industry. The material can be welded with many types of welding process and finished to achieve the needs of a sanitary easily cleanable fabrication. The material can be bent and worked into many shapes. The opening will have a means to fill the annular space with fluid, a means to vent the annular space, and a means to drain the annular space. The location of the fill, vent, and drain should be from the high point of the frame and low point of the frame. The connection to the annular space will be from the top and bottom at the sides using a socket welded elbow and extension piping.

Alternatives: The annular space cast, molded, stamped, or printed components that reduce or eliminate seams and fused connections.

The opening annular space could use a variety of shapes for the frame that the heating element or thermowell attach.

Vents, drains, and fill ports can be made of any tube shape that can be connected to the annular space. Tubing fittings could be welded to the annular space and tubing ran to the outside of the wall.

Component F: The annular space will have a means to determine the level of the oil in the annular space. The use of the fill/vent and drain connections will allow the installation of a simple plastic sight tube with visual indication of the level. Keeping the oil above the heating elements is very important to avoid hot spots on the heating elements.

Alternatives: A solid level sensing tube could be used instead of a flexible plastic tube, but this will be much easier to break if hit.

The use of more sophisticated level devices can be installed. Similarly no level device could be installed and checks for fluid level could be completed by topping off the annular space on a periodic basis.

There are quite a few level sensing devices that could be used. Although these would likely be much more expensive and overly complicated, the system may require a device that is only connected at one place: possibly due to space limitations. Devices that measure pressure can be used at the lower port and calibrated to sense the level, a bubbler system could also be used with a similar pressure sensing device. A capacitive device could be used if a single point level is needed. There are other similar devices.

Levels can be transmitted to various devices to allow alarms and trending of the level if this is important to the process.

Component G: The opening is extended through the enclosure wall to prevent any warm humid air passing through the opening to the inside of the enclosure from easily reaching the surfaces of the enclosure wall. See FIGS. 2 and 25 that show the extensions protruding from the freezer wall surface location. The inside extension directs the flow of air past the wall and allows dispersion and mixing of water vapor with the dry cold air that is typically already circulated inside the enclosure. The dispersion reduces the amount of water vapor depositing of the walls that can cause frost or condensation to drop on items in or passing through the wall. The extension is heated on all sides and will catch frost or condensation that may still find its way to the extension. The use of a lip on the extension directs any liquid from condensation or melted frost to the outsides of the opening and prevents it from reaching the items in or passing through the opening. Heat from the extension is conducted to the wall panels connected to the extension so that frost and condensation are reduced on the wall panel. The heated surfaces of the extension promote evaporation and sublimation of condensation and frost. The extension and lip can be incorporated into the design of any hoods, enclosures, or balance fans on the inside.

An outer extension is similar to the extension on the inside, cold air passing to the outside of the wall can be mixed with air to prevent frost formation on the surfaces around the opening on the outside of the enclosure. The mixing of the air away from the wall prevents the temperatures from reaching the dew point on the wall or on items near the opening. There is also a lip on the outer extension that directs any liquid from condensation or melted frost to the outsides of the opening and prevents it from reaching the items in or passing through the opening. The extension and lip can also be incorporated into hoods, enclosures, fans, and similar equipment.

The bottom of the opening through the wall is sloped to aid in removal of condensation and debris that reach the bottom surface.

Alternatives: No extension could be used for either or both sides of the freezer.

The lip could be removed from the extension.

The lip could be extended down the sides of the opening to further prevent liquids or debris from reaching the opening.

The slope of the top of the extension could be removed from the extension or sloped only to one side or the other.

The slope of the bottom of the opening could be removed from the opening through the wall.

Component H: The use of insulated support blocks that have higher compressive strength than normal insulation materials is used at the conveyor support frame through the wall. Flanged support frame materials made of solid components are attached to the flanges and continue to the conveyor frame. Bolts through the flanges, wall, and opposite flange hold the parts together. The insulated support block transfers force loads of the conveyor through the wall while preventing heat transfer (cold temps) from transferring through the wall. When the shaft that supports the conveyor is near the opening, the bearings that support the shaft can get cold air directed on them and frost will form. The shaft is extended to the sides outside of the cold air stream so that the bearing does not form frost.

Alternatives: The length of the conveyor outside the freezer can be revised to place it farther away from the freezer. This will reduce the amount of frost on conveyor components outside the freezer.

Similar to the main opening, the frame used outside the freezer could be heated with an annular or hollow design to prevent condensation on the outside of the frame. Electric heaters for direct contact heat transfer, could be installed with the use of a fluid (oil) in an annular space, or if a circulated oil heating system is used, via hot oil in an annular space.

The shaft of the freezer belt could be warmed by internal fluids using rotary joints. Similarly an electrical heating element with rotary electrical connection could be used. The design of sprocket parts or other items attached to the shaft could be selected to transfer heat from the shaft to those parts.

No insulated support blocks or modifications to the conveyor frame could be made. The heated opening could be used alone.

Detailed Description of the Drawings and Pictures

The opening sizes, size of slopes, length of opening, shape of opening, size of flanges on the tops of the openings, enclosure thickness are not limited. One of the important unique benefits of the design is that there are unlimited sizes where the opening can be used. All dimensions and components can be revised to reflect the needs of the opening.

Thickness (Gages) of materials and the sizes of welds used to fuse parts together are not included so as not to restrict in any way the size of materials or welds used. Full penetration welds are likely the best option for prevention of leaks; however, other types of welds can be used. The designer may choose to use thicker or thinner materials in various pieces to reduce risk of leaks and/or to reduce costs.

The materials noted on drawings are not included so as not to restrict the use of any other materials. 316L stainless steel is often used for fabrication of food grade equipment and is recommended for the installation. The use of other more exotic metals, plastics, castings, or less exotic carbon steels may be appropriate for the enclosure.

The dimensions of outside or inside corners are not included to restrict the use of any other dimensions. A purpose of the curved outside and inside corners are to allow for ease of cleaning. Outside and inside corners have radius to reduce or eliminate niches for microbiological growth and can be many alternative sizes depending on the needs of the process.

The finish of the surfaces and dimensions of outside or inside corners are not included to restrict the use of any other finish. The finish of surfaces can be any finish felt to achieve ease of cleaning and to promote sanitation with associated reduction in microbiological growth.

For nearly all pieces shown by figures noted below, the shapes can be made of several or as few pieces as possible. Pieces that form the opening and specially the annular space need to be sealed at any of the multiple pieces to contain the fluid. Depending on the fabrication shop capability, these pieces can be fabricated from several pieces and welded in several places. Alternatively one piece could be bent and is welded at the one final connection of the two ends of the single piece.

Some pieces can be fabricated in L or Z shapes in order to limit the amount of welds and thus the chances of leaks at welds. For example, FIG. 18 shows how pieces in FIGS. 21, 7, and 14 could be bent in one piece and welded at the corners of the opening to form the combination of shapes for the annular space. FIG. 19 shows another example. It would be possible to stamp out the shapes for an opening but it is doubtful this method would be cost effective since the size of the opening would likely change often.

When all pieces are fully welded, ground, and smoothed as required; the annular space should be pressure tested and closely inspected for leaks. Five (5) psi air or other gas is the maximum pressure to be used. The annular space is not designed for pressure and should be vented to atmosphere when in normal use. The pressure is used to find any leaks especially for welds that will be hidden inside the enclosure once installed. Any leaks inside the enclosure will be very expensive to repair. Other alternative methods to find cracks can be used, for example die penetrant.

FIG. 1: The refrigerated enclosure opening is shown by an isometric view. The opening fits into a hole cut through the wall or other surfaces of a larger refrigerated enclosure. Refer to FIG. 24 that shows such a cut out. The opening is fastened and sealed to the wall on one side of the wall, insulation is added in the space between the opening and the wall, and then the opening is fastened and sealed to the opposite side of the wall. The opening includes oil fill and vent connections shown by 26 and 27, also connections for level devices and drains 28. This view shows extensions that protrude past the freezer wall on both sides.

FIG. 2: the refrigerated enclosure opening is shown by an exploded view of components. The tube frame FIG. 3, assembled with couplings FIGS. 5 and 29, pipe plugs 6, thermowells 4 and 10 are inserted into the inner combo sleeve FIG. 18. FIGS. 9, 12, and 13 are attached to the assembly. The sleeve FIG. 11 is then attached to the assembly. FIG. 23 shows a completed and installed sleeve, and FIG. 25 shows a cross section of the assembly.

FIG. 3: this is a front, side, and top view of the tube frame. The tube frame serves as a fully seal welded attachment point for FIG. 16 heating elements or thermowells FIGS. 4 and 10. The thermowells are welded to the side of the frame opposite the access couplings and plugs. This arrangement provides a sanitary design conduit for wiring. The use of thermowells instead of a threaded heating element is desired to avoid leaks at the threads or other sealing points of heating elements. FIG. 16 heating elements can have a threaded connection on the wiring end of the element. If threaded heating elements are used, a threaded coupling would have to be installed instead of the thermowell. Couplings FIG. 5 will be welded above the thermowells FIGS. 4 and 10. Coupling 29 will be welded on the frame at a low point and is used to attach drain piping. Coupling 29 is installed to allow installation of an automatic drain device that discharges sanitation liquids that may enter the frame, also providing a method to see potential leaks of oil that occur from inside the frame. The welds that are on the outside of the enclosure have to be sanitary ground and smoothed as they will be outside the enclosure and need to be cleaned or sanitized. Welds for the thermowell or alternative connection will not need to be ground and smoothed. Depending on the type of drain and fill/vent arrangement, pipe or couplings from the inner annular space will be welded on the tube frame. These drains and vents should be installed at the low and high point of the frame so that all fluid can be removed and similarly fluid will completely fill the frame. A rounded wire pulling surface can be provided at square edges of the frame to reduce chances of damage to wiring during wire installation.

FIG. 4: this is a front, and two side view of the thermowell for the temperature sensing element. This piece is identical to the piece in FIG. 10, except that the bore size may be different to reflect the dimensions of the temperature sensing element. This thermowell is a round bar of metal with a bore machined and sized for the sensing element diameter. The thermowell is fully seal welded into the frame to prevent any leaks between the thermowell and the frame. Welds for the thermowell or alternative connection will not need to be ground and smoothed. The thermowell may have to be re-drilled after welding to adjust for warping from welding. The heating elements will be installed using a heat transfer grease to reduce hot spots and chances of damage to the heating element.

FIG. 5: this is a front, and two side view of a pipe half coupling. This is a common coupling used in piping systems "cut in half" so it only has one threaded end. The end that isn't threaded is seal welded to the frame and used with a plug and sealant in FIG. 6, to prevent sanitation chemicals and water from entering the frame. The coupling is large enough to allow relative ease to access the heating elements and is located over the heating element to promote ease of replacement. Welds for the half coupling or alternative connection will need to be ground and smoothed.

FIG. 6: this is a front, and two side view of a pipe plug. This is a common pipe plug or alternative pipe thread closure. The surfaces will be ground and polished to promote ease of sanitation. The plug will be installed with sealant to prevent sanitation chemicals and water from entering the frame.

FIG. 7: this is a front, side, and top view of an Inner Sleeve. This sleeve is similar to the sleeve in FIG. 16, but is located on the inside of the enclosure. It is welded to both pieces shown in FIGS. 9, 12, and 14 as detailed in FIG. 25.

FIG. 8: this is a front, side, and top view of the Exterior Wall Plate. The exterior wall plate is welded to the frame piece on the outside of the enclosure, as shown in FIG. 25. The plate can be one or more pieces with all seams fully welded. The plate is seal welded, ground, and polished because it will be sanitized. The size of the piece(s) is determined by the design of the installation and clearances to inner and outer equipment or obstructions. Older freezers with enclosure panels that are not seal welded may need a larger piece to provide more distance from the exposed enclosure panel to the opening. The piece in FIG. 8 is sealed to the existing walls using sealants or caulks and held together with fasteners that penetrate through the enclosure to the inside of the enclosure. The fasteners may be seal welded in place to reduce chances of microbiological growth under the fasteners to the plate. The more distance from the opening to the edge of the plate, the less likely of microbiological contamination or growth reaching the opening. The wall plate provides a surface that is easy to clean and keep sanitary versus enclosure panels whose surfaces are not as easy to clean and keep sanitary. New freezer installations may use much smaller or no plate as the opening can be integrated into the enclosure panels and welded directly to those. Similarly a new installation may not need through fasteners. A drip ledge is added as shown on FIG. 23 and also shown in FIG. 25, where the drip ledge FIGS. 12 and 13 are integrated along with a cover system to prevent debris from falling from above.

FIG. 9: this is a front, side, and top view of the Interior Wall Plate. This piece is nearly the same as that in FIG. 8. The plate can be one or more pieces with all seams fully welded. It is located on the inside of the freezer enclosure. It may be larger or smaller in size than the piece in FIG. 8 depending on the design of the interior of the enclosure. The conditions on the inside of the enclosure may also call for a larger size. IE: a cooler may be capable to grow microorganisms due to higher temperatures and this may call for larger distances from the opening to the side of the piece (FIG. 9) where it attached to enclosure surfaces.

FIG. 10: this is a front, and two side view of the thermowell for the heater element. This thermowell is a round bar of metal with a bore machined and sized for the heating element diameter. The thermowell is fully seal welded into the frame to prevent any leaks between the thermowell and the frame. Welds for the thermowell or alternative connection will not need to be ground and smoothed. The thermowell may have to be re-drilled after welding to adjust for warping from welding. The heating elements will be installed using a heat transfer grease to reduce hot spots and chances of damage to the heating element.

FIG. 11: this is a front, side, and top view of a sleeve. This sleeve is the innermost piece of the annular space. It passes from the inside of the enclosure to the outside of the enclosure. It has a larger radius at the corners to promote ease of cleaning. Its surfaces are the most critical to be ground and prepared to obtain successful sanitized condition after cleaning. This piece is welded to pieces shown in FIGS. 12 and 13, which are the face of the extension of the opening for either side, as detailed in FIG. 25. The bottom surface of this piece (FIG. 11) is sloped to allow any liquids to flow from the opening. Designers can choose to slope in two directions or must decide to slope to the inside or outside of the enclosure. Sloping from the opening allows for liquids to be captured or otherwise controlled to flow as needed.

FIG. 12: this is a front, side, and top view of a sleeve inner face. The sleeve forms a face between the inner sleeve shown by FIG. 11 and the outer sleeve shown by FIG. 7. It is located on the outer edge of the opening on the inside of the enclosure. Refer to FIG. 25. This face is also very important to be ground and prepared to obtain successful sanitized condition after cleaning. FIG. 12 piece is designed with an edge that extends the entire length of the inner sleeve shown by FIG. 7. The edge creates a channel to direct any liquids to the sides of the opening. The height of the edge above FIG. 7 piece depends on the amount of frost or liquids falling into the channel, and dependent on conditions on the inside of the enclosure. It attaches to FIGS. 7 and 11 with seal welds and must be ground and smoothed for a sanitary design condition for cleaning.

FIG. 13: this is a front, side, and top view of a sleeve outer face. This piece is nearly identical to the piece shown in FIG. 12, except it is located on the outside of the opening. It attaches to pieces shown by FIG. 16 and FIG. 11 with seal welds and must be ground and smoothed for a sanitary design condition for cleaning. Refer to FIG. 25.

FIG. 14: this is a front, side, and top view of an inner plate. This plate attaches to the piece shown by FIG. 17 and FIG. 7 with full penetration seal welds. It forms the end of the annular space that is near the enclosure inner wall, roof, or floor sheeting. Refer to FIG. 25. These welds do not need to be sanitary ground and smoothed as they will be inside the enclosure and under the piece shown by FIG. 9, and the welds are not periodically cleaned or sanitized.

FIG. 15: this is a front, side, and top view of an outer plate. The outer plate is similar to the piece shown by FIG. 14, except that it is on the outside of the enclosure and fastens with full penetration welds to pieces shown by FIG. 16 and FIG. 3. The welds need to be ground and smoothed for a sanitary condition after cleaning. Refer to FIG. 25.

FIG. 16: this is a drawing for a pencil heater.

FIG. 17: this is a drawing for a temperature sensor with thermostat. The temperature setting is controlled by an adjustment screw. The adjustment screw can be accessed through the coupling above the sensor by removing the pipe plug FIG. 6. See FIG. 23 of the prototype.

FIG. 18: this is a combination of all three pieces shown by FIGS. 7, 14, and 21. The bottom and sides are made of a bent piece of stainless steel and miter cut on the ends. The top is made of two pieces with the sloped top separate and welded to the assembly. This is a preferred method as it reduces the number and minimizes the length of welds that will be located inside the wall.

FIG. 19: this is a combination of two of the pieces shown by FIGS. 15 and 22. The bottom and sides are made of a bent piece of stainless steel and miter cut on the ends. The top is made of one piece with a notch in the middle of the piece shown by FIG. 15, and with a larger dimension to allow for later cutting to size. Once the top is bent to achieve the slope, a small filler piece is welded on both sides to the middle of the piece shown in FIG. 15. The flange of the piece in FIG. 15 is sheared or cut to size after it is bent, and miter cut on the ends. This is a preferred method as it reduces the number and minimizes the length of welds that will be located inside the wall.

FIG. 20: this is a front, side, and top view of the opening. (Openings in the top and bottom of the enclosure are similar but would normally be without the need for sloped surfaces.) This figure shows potential locations for fill and vent, 26 and 27, as well as drain 28.

FIG. 21: this is a front, side, and top view of an Outer Sleeve shown by the piece in FIG. 21. This outer sleeve is the outermost piece that connects to the main tube/frame that holds the heating elements or thermowells. It is seal welded to the main tube on both sides of the sleeve with full penetration welds. These welds do not need to be sanitary ground and smoothed as they will be inside the enclosure and not cleaned or sanitized. The space between the enclosure and the piece shown by FIG. 21 will be filled with insulation to prevent heat transfer from the inside of the enclosure to the outside. Refer to FIG. 25. This figure shows potential locations for fill and vent, 26 and 27, as well as drain 28.

FIG. 22: this is a front, side, and top view of an Outer Sleeve shown by piece in FIG. 22. The outer sleeve is the outermost piece that is part of the extension through the enclosure on the outside of the enclosure. It connects to another piece, FIG. 15 that forms a face against the main tube FIG. 3, that holds the heating elements or thermowells, FIGS. 4 and 10. FIG. 22 is sloped to the sides from the middle. Sloping to one side or the other is also possible if required by design. It is seal welded to the face piece with full penetration welds. These welds have to be sanitary ground and smoothed as they will be outside the enclosure and need to be cleaned or sanitized.

FIG. 23: This is a picture of a prototype opening installed in a freezer wall of a food process. This picture shows the outer wall FIG. 8 that has been polished for sanitary cleaning. It shows the couplings and plugs FIGS. 5 and 6 located above the sloped extension FIG. 22 that includes a face with a lip FIG. 13. An oil level sensing piping arrangement is shown from the connections provided by FIG. 21. The design allows for sanitary electrical connections located at the low side of the opening that will reduce chances of contamination getting to the product and conveyor belts. The FIG. 23 shows the support bracket that extends from the sides of the opening and is fastened through the freezer wall. The support fasteners run through the wall and support block to the inside of the freezer. Fasteners are seal welded to improve sanitary design.

FIG. 24: This is a picture of the opening cut into the freezer wall before installation of the opening assembly. The insulation block is shown inserted into the wall and before being sealed with insulation foam to the freezer walls. The picture also shows the conveyor frame that has been shortened to accept support brackets that run to the freezer wall at the insulation block.

FIG. 25: This is a cross section A-A through the opening of a wall at a thermowell and vent. Piece numbers are shown which are detailed in separate drawings noted above.

Method of Fabrication and Installation Description:

This unique invention and this design allows the larger Pieces to be fused together (welding is most likely the most economical method) to fabricate an enclosed annular space that will hold the heated fluid (the term oil will be used in future explanation) and not leak over many years of use; as well as have a smooth sanitary surface. The method of fabrication as presented has been proven by installed prototype, refer to FIG. 23, to show the ability to make the opening; but is not meant to limit the choices of fabrication. The steps presented are one of several methods to use and are not the only method possible. Any steps and method that produces the leak free annular space that has a sanitary smooth surface are acceptable.

There are many types of welding process that can be used, TIG, MIG, Stick, etc., and the choice of which to use depends on the ability of the welder to produce a leak free weld, that can also be finished to achieve the needed smoothness and finish that promotes sanitation to prevent and reduce microbiological issues.

This applies to all welds for all pieces. Full penetration welds and fillet welds are typical to produce the strongest fusion of the mated Pieces. Where possible a cap weld is added to the opposite side of the full penetration weld to further reduce chances of cracks and leaks. Mating pieces have the edges beveled to promote full weld penetration. This method presented is not meant to limit the types of welds that might be used, all will work as long as they produce a leak free weld and can be finished to achieve sanitation cleaning needs.

The frame, shown by FIG. 3, has openings added to allow for the attachment of thermowells and for the access port half couplings.

Drain couplings are added at the bottom for use by drain piping. A coupling is added to the bottom of the frame to allow any liquids that get past the access port plugs to be drained. The coupling is located at the bottom of the frame so that all liquids will leave the frame. Piping is added from the frame drain to a mechanical automatic drain. Alternatively an elbow or piping could be welded to the frame and piping connected through to a location outside the wall.

The edges of the frame pieces, thermowells, and couplings are ground for full penetration welds, the frame will be cut at angles (mitered) and to correct dimensions, then prepared for welding to allow full penetration welds. Rounded surfaces where wires will contact will be added.

The fabrication must be welded continuous and leak free so that no hot oil can reach the inside cavity of the frame. The quality of welds are especially important on the thermowell welds to frame and the face of the frame that has hot oil against it. These welds can't be reached once the opening is installed and they would be very difficult to repair if they crack or leak. Thermowells, piping, and couplings are seal welded to the frame while the frame can be more easily turned and adjusted to promote ease of welding and thus quality of weld, as well as ease of grinding/finishing of welds.

The piece shown by FIG. 21, and part of combo piece 18, is welded continuous to the frame shown by FIG. 3. The inner side of the combo piece in FIG. 18, that touches the oil, FIG. 21, is continuous fillet welded to the frame. The opposite side of the piece in FIG. 18 that does not touch the oil is continuous penetration welded to the frame at the outside edge. The combination of welds on both sides provides a weld that is very strong and unlikely to leak. The drain, fill, and vent elbows can be welded on the outside of the FIG. 18 piece when the assembly is lighter weight and to promote ease of welding.

The piece shown by FIG. 19 is then welded continuous to the frame, shown by FIG. 3. The inner side of the piece shown by FIG. 15, that touches the oil, is continuous fillet welded to the frame. The opposite side of the piece shown by FIG. 15, that does not touch the oil, is continuous penetration welded to the frame at the outside edge. The outside weld will need to be ground and finished for sanitary cleaning. Refer to FIG. 25.

The piece shown by FIG. 13 is then welded continuous to the piece shown by FIG. 22 (combo FIG. 19). A fillet weld is made on both the inner annular space oil side of the piece shown by FIG. 16 and the exterior side of this piece at the top. Full penetration welds are made on the sides and bottom with a fillet weld on the inside. The exterior side that is in the sloped extension and next to the lip will need to be ground and finished for sanitary cleaning.

The piece shown by FIG. 12 is then welded continuous to the piece shown by FIG. 7 (combo FIG. 18). A fillet weld is made on both the inner annular space oil side of the piece shown by FIG. 7 and the exterior side of the piece shown by FIG. 12 at the top. Full penetration welds are made on the sides and bottom with a fillet weld on the inside. The exterior side of FIG. 7 that is in the sloped extension and next to the lip will need to be ground and finished per sanitary design specifications.

The piece shown by FIG. 11 is then welded continuous to the piece shown by FIGS. 12 and 13. Because pieces shown by FIGS. 12 and 13 can't get an interior backup weld, these welds are particularly important to ensure full penetration and full fusion. The use of a small (¼") square SS backer bar is appropriate to aid in achieving the full fusion welds.

The piece shown by FIG. 9 can be welded continuous to the opening assembly on FIG. 7 before installing into the freezer wall. Fillet welds should be made to the piece shown by FIG. 7 (combo FIG. 18) that will be inside the freezer wall. Fillet welds should also be made to the piece shown by FIG. 18 (corner of pieces shown in FIGS. 7 & 14) and ground and finished. Welds can be ground and finished before installation, to reduce the time it takes to install the opening. Anchor bolt holes can be added to the piece shown by FIG. 9 for use to hold the assembly in place while the opposite side plate is fit and installed. The piece shown by FIG. 9 has caulk added to the edges during the final attachment of the plate shown by FIG. 8.

The piece shown by FIG. 8 is field fit to the opening to accommodate for the height of the opening to the floor and other freezer dimensions. The piece in FIG. 8 is cut for the fill, vent, and drains. The plate in FIG. 8 can be fully welded at the edges and finished to allow no heat damage to caulk that will be added at the edges later on.

If the opening will utilize a design to route the conveyor frame or similar item outside the opening, the freezer wall is prepared for the support block as shown in FIG. 24. Once the support block is fit and has insulation installed (expanding foam recommended) around the gaps, the piece(s) shown by FIG. 8 can be set in place. The pieces shown in FIGS. 8 and 9 are caulked behind the plates and anchor bolts tightened. If welds are not complete, they are welded continuous at seams and to the piece shown by FIGS. 3 and 21. Anchor bolts that are added to the plates have acorn nuts installed and these and the head of the bolts or other fasteners at the wall plate, are seal welded to the plates. These welds need to be ground and finished per sanitary design specifications.

The supports for the conveyor are modified on the inside and outside as required by the design to hold up the conveyor and prevent flexing of the supports.

The heaters and temperature switches are installed and the electrical wiring for both are routed outside the frame to the electrical junction boxes and control boxes.

The oil level piping and tubing, fill ports, vents, and drain piping will be added.

What is claimed is:

1. A refrigerated enclosure opening comprising:

a passage from a first opening of a refrigerated enclosure to a second opening;

one or more annular heated structures around said passage;

an assembly with food safe surfaces;

one or more support systems around said passage, wherein a heated surface surrounding the one or more annular heated structures reduces or eliminates frost and condensation from the heated surfaces and one or more support systems, wherein said heated surface of the one or more annular heated structures further comprises one or more extensions with one or more lips on a face of one or more extensions.

2. The refrigerated enclosure opening of claim 1, wherein said one or more annular heated structures further comprising an operating pressure at ambient.

3. The refrigerated enclosure opening of claim 1, wherein said one or more annular heated structures further comprising one or more access fittings.

4. The refrigerated enclosure opening of claim 1, wherein said one or more annular heated structures is heated using liquid or steam.

5. The refrigerated enclosure opening of claim 1, wherein said one or more annular heated structures further comprising one or more thermowell heating elements.

6. The refrigerated enclosure opening of claim 5, wherein said one or more thermowell heating elements further comprising an access from sanitary polished surface plugs above the elements.

7. The refrigerated enclosure opening of claim 5, wherein the heated surface comprises a plurality of heated surfaces, wherein said one or more thermowell heating elements is arranged to allow for heat control of the plurality of heated surfaces.

8. The refrigerated enclosure opening of claim 7, wherein one or more thermowell heating elements is controlled by on/off manual and/or through automated control.

9. The refrigerated enclosure opening of claim 1, wherein said one or more annular heated structure further comprising oil inside the one or more annular heated structure.

10. The refrigerated enclosure opening of claim 9, wherein said oil further comprising a food grade specification.

11. The refrigerated enclosure opening of claim 1, wherein said assembly further comprising one or more wiring paths to run below the first or second opening and to the sides of the first or second opening.

12. The refrigerated enclosure opening of 1, wherein said one or more supports further comprising load bearing insulated blocks inside the freezer walls.

13. The refrigerated enclosure opening of claim 1, wherein said food safe surfaces further comprising sloped surfaces, components that are food safe, and rounded inside corners that promote ease of effective cleaning to achieve food safe conditions after cleaning.

14. The refrigerated enclosure opening of claim 1, wherein said assembly with food safe surfaces further comprising a material that does not rust or stain.

* * * * *